US006393856B1

(12) United States Patent
Gunji et al.

(10) Patent No.: US 6,393,856 B1
(45) Date of Patent: May 28, 2002

(54) AIR CONDITIONER

(75) Inventors: Yoshihiro Gunji; Akimasa Shirai; Masamitsu Sahara, all of Kawasaki (JP)

(73) Assignee: Fujitsu General Limited, Kawasaki (JP)

( * ) Notice: Subject to any disclaimer, the term of this patent is extended or adjusted under 35 U.S.C. 154(b) by 0 days.

(21) Appl. No.: 09/442,939

(22) Filed: Nov. 18, 1999

(30) Foreign Application Priority Data

Nov. 20, 1998 (JP) ..... 10-330431
Mar. 5, 1999 (JP) ..... 11-057808
Oct. 25, 1999 (JP) ..... 11-302339

(51) Int. Cl.[7] ..... F25D 19/00
(52) U.S. Cl. ..... 62/298; 62/259.1; 62/DIG. 16
(58) Field of Search ..... 62/259.1, 298, 62/DIG. 16

(56) References Cited

U.S. PATENT DOCUMENTS 4,702,087 A * 10/1987 Nakajima et al. ..... 62/285
4,895,066 A * 1/1990 Carnaham ..... 98/42.22
5,029,451 A * 7/1991 Imaiida et al. ..... 62/259.1
5,495,724 A * 3/1996 Koster ..... 62/259.1
5,522,768 A * 6/1996 Brodt et al. ..... 454/234
5,595,068 A * 1/1997 Amr ..... 62/418
5,669,229 A * 9/1997 Ohbayashi et al. ..... 62/259.1
5,987,908 A * 11/1999 Wetzel ..... 62/259.1

* cited by examiner

*Primary Examiner*—William Doerrler
*Assistant Examiner*—Mark Shulman
(74) *Attorney, Agent, or Firm*—Kanesaka & Takeuchi

(57) ABSTRACT

In a ceiling recessed type air conditioner including a case body hung from a ceiling slab via hanging bolts and a panel base mounted on the lower face side of the case body, a decorative frame can be selectively installed at different height positions on the side wall of the panel base via an installation position changing device. Thereby, even when the height space in the ceiling in which the case body is installed is limited and a part of the case body projects from the ceiling surface, a front panel portion can be installed with good appearance.

31 Claims, 26 Drawing Sheets

AIR CONDITIONER

TECHNICAL FIELD

The present invention relates to an air conditioner in which most of components are contained in a space in the ceiling, and only a front panel portion is disposed on the ceiling surface. More particularly, it relates to an air conditioner of a so-called ceiling recessed type which can be installed so that the appearance of the front panel portion is good even if the height space in the ceiling is limited.

BACKGROUND ART

An air conditioner is equipped with an indoor unit for making heat exchange of indoor air and an outdoor unit for dissipating heat to the outside air or absorbing heat from the outside air. The indoor unit is fixed to the wall or placed on the floor. In particular, in an office building or a store, the indoor unit is preferably installed on the ceiling so that the floor surface or the wall surface can be used effectively.

Even when the indoor unit is installed on the ceiling, importance is given to the appearance thereof. For this reason, the indoor unit is installed in a space in the ceiling as a ceiling recessed type. One example thereof will be explained with reference to a perspective view of FIG. 30 and a sectional view of FIG. 31 showing the installation state. In the description below, an air conditioner means an indoor unit.

An air conditioner (indoor unit) 1 is provided with a box-shaped case body 2 whose lower face on the indoor side is open. At the central portion of the case body 2, there are provided a centrifugal fan 21 and a drive motor 22 therefore with the rotating shafts thereof being substantially vertical. A heat exchanger 23 is arranged around the centrifugal fan 21. Under the heat exchanger 23 is provided a drain pan 24 serving as a drip pan.

At the center on the lower face side of the case body 2, there is provided a bell mouth 25 forming a suction port for the centrifugal fan 21. Also, at the peripheral portion on the lower face side of the case body 2, there are formed air ports 26 for the air heat-exchanged in the heat exchanger 23. On the lower face side of the case body 2, there is installed a front panel (also referred to as a decorative panel) 3 by using not illustrated fixing means such as screws.

The front panel 3 has, at the center thereof, an air suction port 31 communicating with the bell mouth 25, and a suction grille 32 is detachably mounted in the air suction port 31. A filter 33 is disposed on the inside of the suction grille 32. Also, at the peripheral portion of the front panel 3, there are formed air blow ports 34 communicating with the air ports 26 in the case body 2. Although not shown in the figure, an air deflector is provided in the air blow port 34.

In the prior art, the case body 2 is hung from a ceiling slab 5 via hanging bolts 4 in a state in which the front panel 3 is installed to the case body 2 as described above. Then, the height of the case body 2 is adjusted by the hanging bolts 4 so that the front panel 3 is substantially flush with a ceiling plate 6. After the height of the case body 2 has been adjusted, the ceiling plate 6 is installed along a not illustrated support skeleton.

By the way, the height space in the ceiling is not constant for each building. Therefore, the case body 2 is hung by using the hanging bolts 4 that can make height adjustment. However, the adjustment made by the hanging bolts 4 is effective only when the height space in the ceiling is greater than the height of the case body 2.

In order to enhance the room environment, there has been a tendency to make the ceiling higher in recent years, so that the height space in the ceiling has been decreased relatively. On the other hand, for the air conditioner, the heat exchanger etc. have been made larger in size to enhance the air conditioning capability, and accordingly the height of the case body 2 has been increased.

Therefore, even if the height adjustment is made fully by using the hanging bolts 4, the case body 2 cannot be contained in the ceiling completely, so that a part of the lower portion thereof sometimes projects from the ceiling surface. In this case, a gap is developed between the front panel 3 and the ceiling plate 6, by which the appearance is marred, and the product value is decreased remarkably. In some cases, the type of product is inevitably changed, so that a heavy loss may be caused.

SUMMARY OF THE INVENTION

According to the present invention, the above problem is solved, and even when the height space in the ceiling in which a case body of an air conditioner is installed is limited and a part of the case body projects from the ceiling surface, the appearance of a front panel portion can be made good.

Specifically, the present invention provides a ceiling recessed type air conditioner comprising a case body which comprises a rectangular parallelepiped shaped box whose lower face on the room side is open and is supported by hanging bolts in the ceiling so that the height thereof is adjustable; and a panel base which is formed into a square frame shape and is attached to the lower face side of the case body, in which the case body contains a centrifugal fan, a motor for driving the centrifugal fan, and a heat exchanger disposed around the centrifugal fan; a bell mouth forming a suction port for the centrifugal fan and air ports for the air heat-exchanged by the heat exchanger are provided on the lower face side of the case body; and the panel base is provided with air deflectors disposed corresponding to the air ports and a suction grille communicating with the suction port of the bell mouth, wherein a decorative frame is selectively installed at different height positions on the side wall of the panel base via installation position changing means.

In the present invention, the front panel is made up of two elements of the suction grille and the decorative frame. The suction grille is fixed to the panel base, but the height of the decorative frame can be adjusted with respect to the panel base. Therefore, when the height space in the ceiling is larger than the size of the case body, the decorative frame is set at a height position substantially located on the extension of surface of the suction grille (normal position). Thereby, the suction grille and the decorative frame are recognized as an integral object in appearance.

Contrarily, when the height space in the ceiling is limited and cannot fully contain the case body so that a difference in level is developed between the suction grille and the ceiling plate, the decorative frame is set at an adjust position higher than the normal position. Thereby, no gap is developed between the decorative frame and the ceiling plate, so that the appearance can be kept good.

The present invention provides some characteristic installation position changing means to set the decorative frame at different height positions. As one of them, there is first installation position changing means which comprises hooks provided on predetermined two opposing sides of the decorative frame, shallow first grooves formed on two opposing sides of the panel base so as to be engaged with the hooks, and deep second grooves formed on the other two opposing sides of the panel base so as to be engaged with the hooks. According to this means, by engaging the hooks with the first grooves or the second grooves, the decorative frame can be held at a different height position with respect to the panel base.

In this first installation position changing means, a mode in which the hook is formed into an inverse U shape engaging with the groove from the upside is recommended as a preferable mode. Also, by providing ribs, which come into contact with both sides of the hook, under the first groove or the second groove, the transverse movement of the hook can be restrained.

In this case, it is preferable that the rib has an inclined face whose height increases gradually toward the lower side. According to this configuration, the hook can be engaged smoothly with the groove.

According to second installation position changing means, which is a feature of the present invention, a corner cut portion is formed at each corner of the panel base, and the installation position changing means compensates the shape of the corner cut portion and is provided with corner members fixed to the corner cut portions. According to this configuration, the decorative frame is held on the panel base via the corner members so that the height is adjustable.

In the second installation changing means, the corner member has right and left side plates bent through 90 degrees, an attachment portion which is screwed to the corner of the panel base is provided on the inside of the corner member, and screw insertion holes are formed at different height positions in at least one of the side plates, so that the decorative frame is fixed to the position of either screw insertion hole.

When the aforementioned corner members are used, an L-shaped step portion for engaging with the inside face of the corner cut portion is preferably formed at the end of each side plate of the corner member to make the side face of the corner member and the side face of the panel base flush with each other.

Third installation position changing means, which is a feature of the present invention, is provided with first engagement means engaging at a lower height position when the decorative frame is fitted onto the panel base from downside to the upside on the room side, and second engagement means engaging at a higher height position.

According to a preferable mode of the third installation position changing means, when the decorative frame is fitted onto the panel base, by turning the decorative frame through 90 degrees in the horizontal plane, either one of the engagement means can be selected.

In the third installation position changing means, it is preferable that the engagement means comprise a combination of a protrusion provided on the side wall of the panel base and an elastically deformable engagement member which has a fit hole fitting onto the protrusion, and are formed on the inside wall of the decorative frame.

Also, in the third installation position changing means, it is preferable that between the panel base and the decorative frame, the first engagement means and the second engagement means be provided adjacently at two places at the right and left ends of each side so as to be asymmetrical with respect to the centerline of the side, and the positions of the first engagement means and the second engagement means be changed on the two opposing sides and on the other two opposing sides. According to this configuration, by turning the decorative frame through 90 degrees in the horizontal plane, either one of the engagement means can be selected.

In the third installation position changing means, it is preferable that the protrusion of the first engagement means be provided directly on the side wall of the base panel, while the protrusion of the second engagement means be provided on the inside face of a portal frame formed on the side wall of the panel base, and the engagement member of the first engagement means be provided so as to come into contact with the side wall of the panel base, while the engagement member of the second engagement means be provided so as to come into contact with the inside face of the portal frame.

According to the present invention, the third installation position changing means is further provided, in addition to the first and second engagement means, with third engagement means for holding the central portion of the decorative frame. The third engagement means has two engagement claws provided in parallel at the same height position at the central portion of each wall of the decorative frame and two engagement holes formed in parallel at different height positions at the central portion of each inside wall of the decorative frame so that one engagement claw is fitted into one engagement hole at the higher position when the first engagement means is selected and the other engagement claw is fitted into the other engagement hole at the lower position when the second engagement means is selected. According to this configuration, the central portion of each inside wall of the decorative frame can be held surely, and the decorative frame can be fixed to the panel base without looseness.

Besides, the present invention includes some preferable modes described below. First, the panel base is provided with a driving portion for driving the air deflector, and the driving portion is preferably covered by a protective cover. According to this configuration, when the suction grille is removed for maintenance, the worker can be prevented from touching the driving portion inadvertently. Also, the panel base is preferably provided with bearings for rotatably supporting the central portion on the back face side of the air deflector to prevent the intermediate portion of the air deflector from being deflected.

The air port is formed of a heat insulating material, and the panel base is formed with an air blow opening communicating with the air port. In this case, the lower end of the heat insulating material forming the air port is tightly inserted between the side wall of the panel base and the side wall of the air blow opening opposing thereto. Thereby, the heat insulating property of the air blow portion is improved, by which dew condensation caused by the leakage of cool air is prevented. Also, the side wall of the air blow opening is formed into a curved shape so as to be curved toward the side wall lower end side of the panel base. Thereby, the air blow resistance can be reduced.

The panel base and the suction grille (front panel) are made of a synthetic resin. In case of ceiling recessed type, the suction grille is considerably large, so that a warp or deflection is prone to occur. In the present invention, therefore, the panel base is molded integrally with a front panel having first openings corresponding to the air ports and a second opening corresponding to the suction port of the bell mouth, by which a front panel with high rigidity is obtained. In this case, the suction grille has a size corresponding to the second opening, and is molded separately from the front panel.

DETAILED DESCRIPTION

Figure 1:
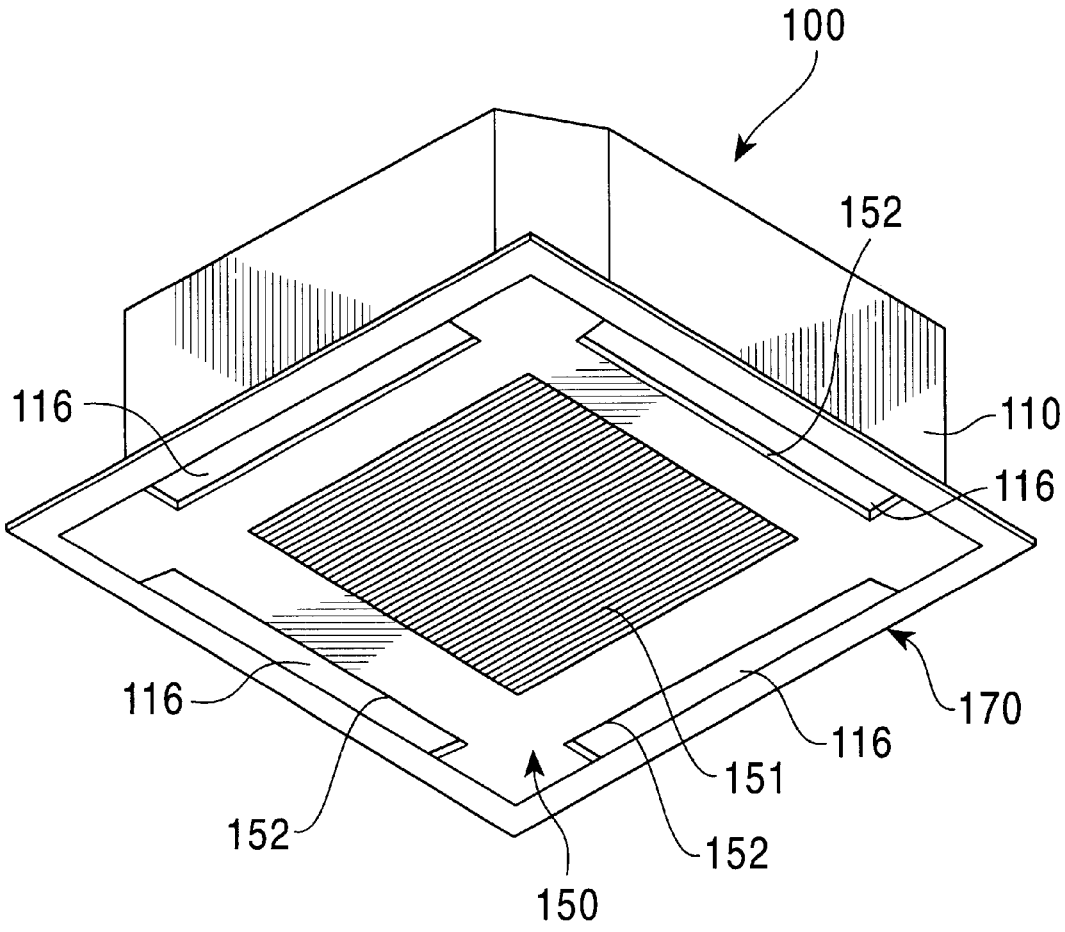
FIG. 1 is a perspective view showing an appearance of an air conditioner in accordance with a first embodiment of the present invention.
Figure 2:
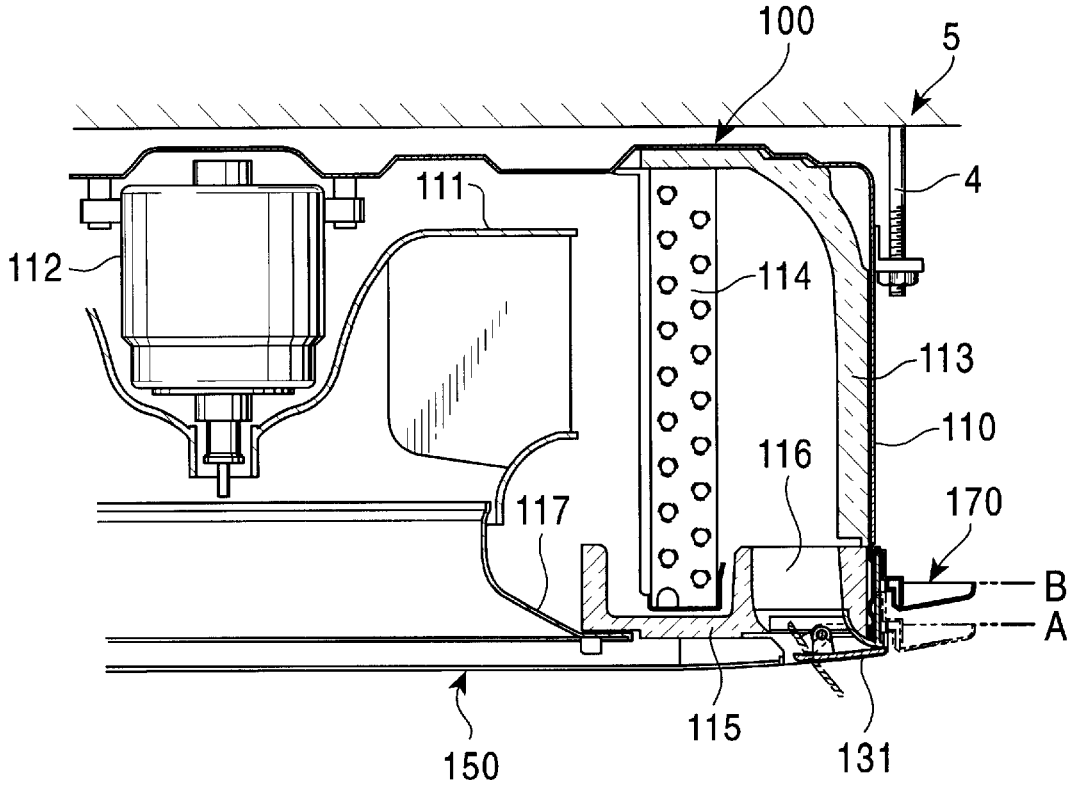
FIG. 2 is a partially sectional view of the air conditioner in accordance with the first embodiment, which is installed in the ceiling.

First, a first embodiment of the present invention will be described. FIG. 1 is a perspective view showing an appearance of an air conditioner in accordance with the first embodiment of the present invention. FIG. 2 is a sectional view of the air conditioner that is installed in the ceiling. For convenience in drawing, FIG. 2 shows only the right half. It should be understood that the left-hand portion is symmetrical to the right-hand portion.

An air conditioner 100 has a case body 110 hung from a ceiling slab 5 by means of hanging bolts 4. The case body 110 comprises a metallic box whose lower face is open to the room side, and a heat insulating material 113 is attached to the inside wall thereof. At the center in the case body 110, there is provided a centrifugal fan 111 and a drive motor 112 therefore with these rotating shafts being substantially vertical.

In the case body 110, a heat exchanger 114 is disposed around the centrifugal fan 111. Under the heat exchanger 114, a drain pan 115 is provided to receive condensation water. The drain pan 115 is, for example, made of an expanded synthetic resin. In this embodiment, air ports 116 are formed integrally with the drain pan 115 to blow air heat-exchanged in the heat exchanger 114 into the room.

As shown in FIG. 1, the air port 116 is disposed along each side of the case body 110 as a rectangular opening. At the central portion on the lower face side of the case body 110, a bell mouth 117 having a suction port for the centrifugal fan 111 is provided coaxially with the centrifugal fan 111.

Figure 3:
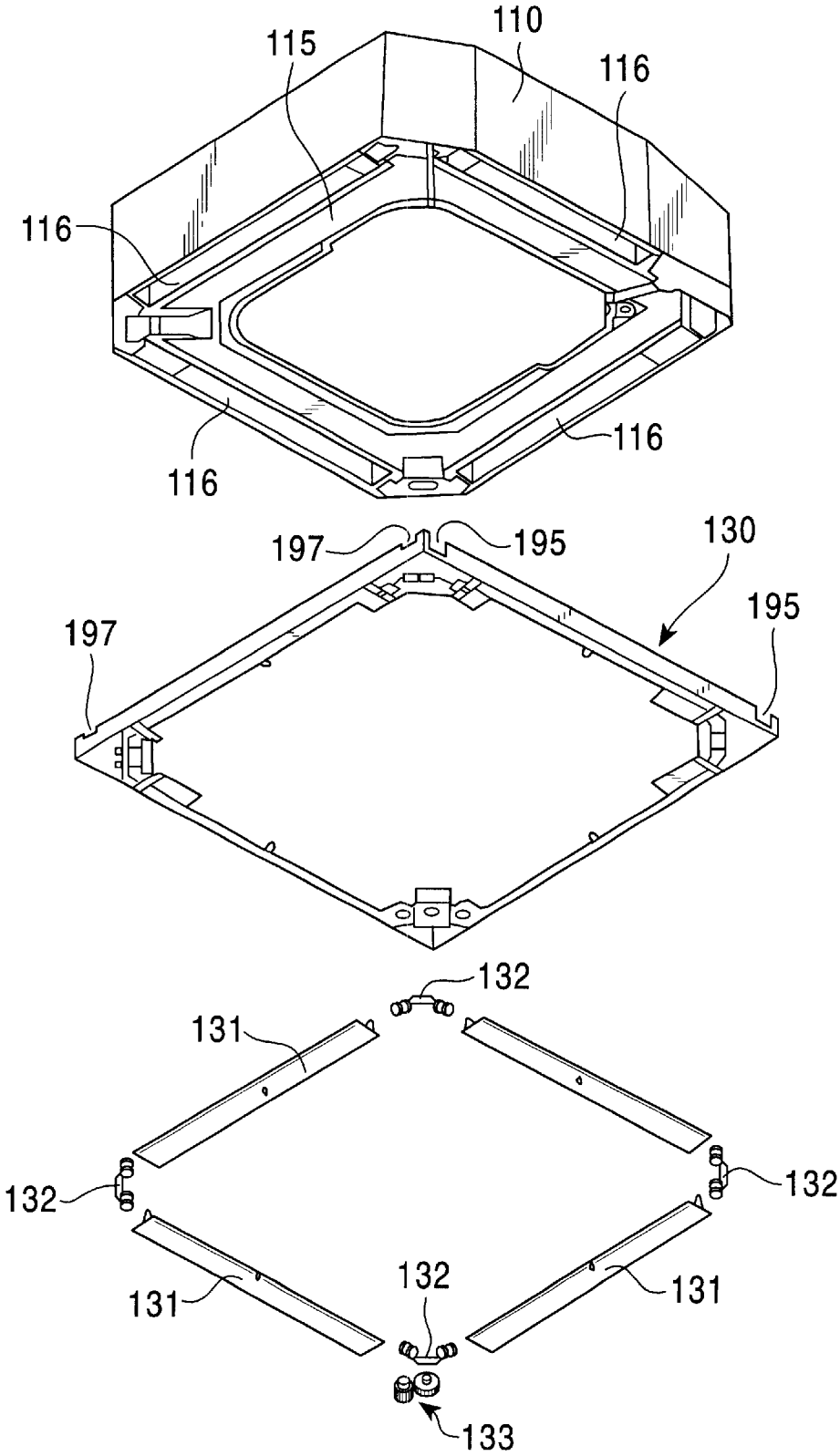
FIG. 3 is an exploded perspective view of a case body and a panel base in the air conditioner in accordance with the first embodiment.

As shown in an exploded perspective view of FIG. 3, a panel base 130, which is formed into a square frame shape by using a synthetic resin, is fixed to the lower face of the case body 110 by means of screws or other fixing means. The panel base 130 is provided with air deflectors 131. In this case, four air deflectors 131 are provided, and each of them is disposed at a position corresponding to the air port 116 of the case body 110.

Although not shown in detail in the figures, the panel base 130 is provided with bearings for rotatably supporting both ends of each of the air deflectors 131. The air deflectors 131 are connected to each other via joints.132 so as to be rotated synchronously. As the joint 132, a universal joint, a flexible shaft, or the like is used.

Figure 10:
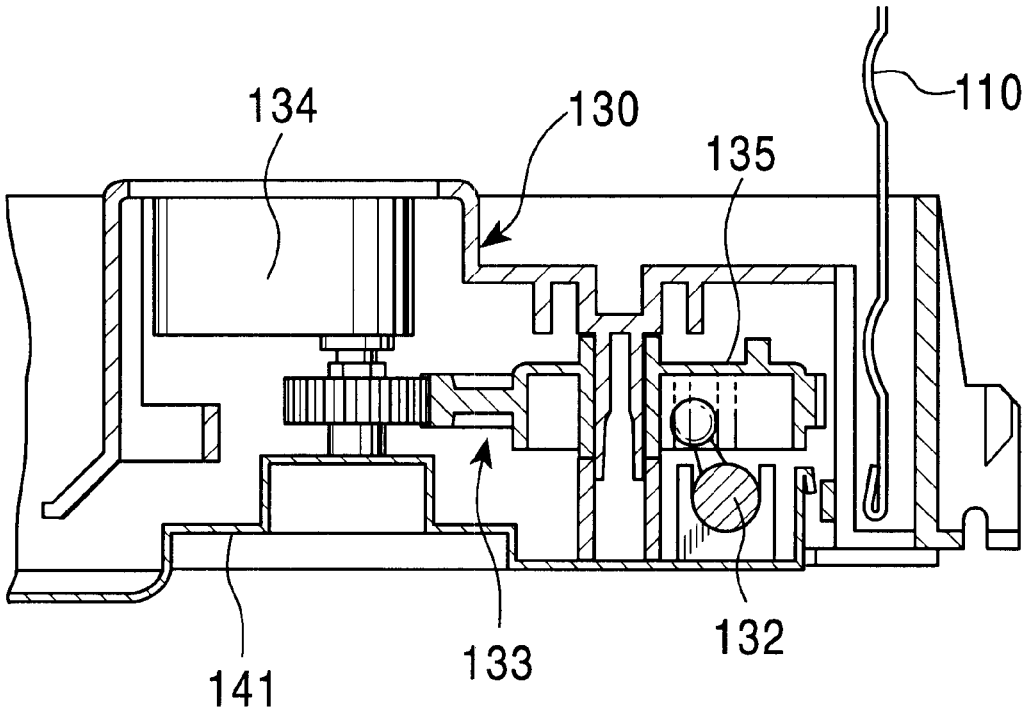
FIG. 10 is a sectional view of an installation portion of an air deflector drive portion in the air conditioner in accordance with the first embodiment.

The joints 132 are arranged at four corners of the panel base 130. One of these joints 132 is connected with an air deflector driving portion 133. As shown in FIG. 10, the air deflector driving portion 133 has a motor 134 and a motion converting mechanism 135. The motion converting mechanism 135 converts the rotational motion of the motor 134 into a reciprocating rotation, and transmits it to the joint 132. Thereby, the air deflectors 131 are rotated in a reciprocating manner within a predetermined angle range.

Figure 4:
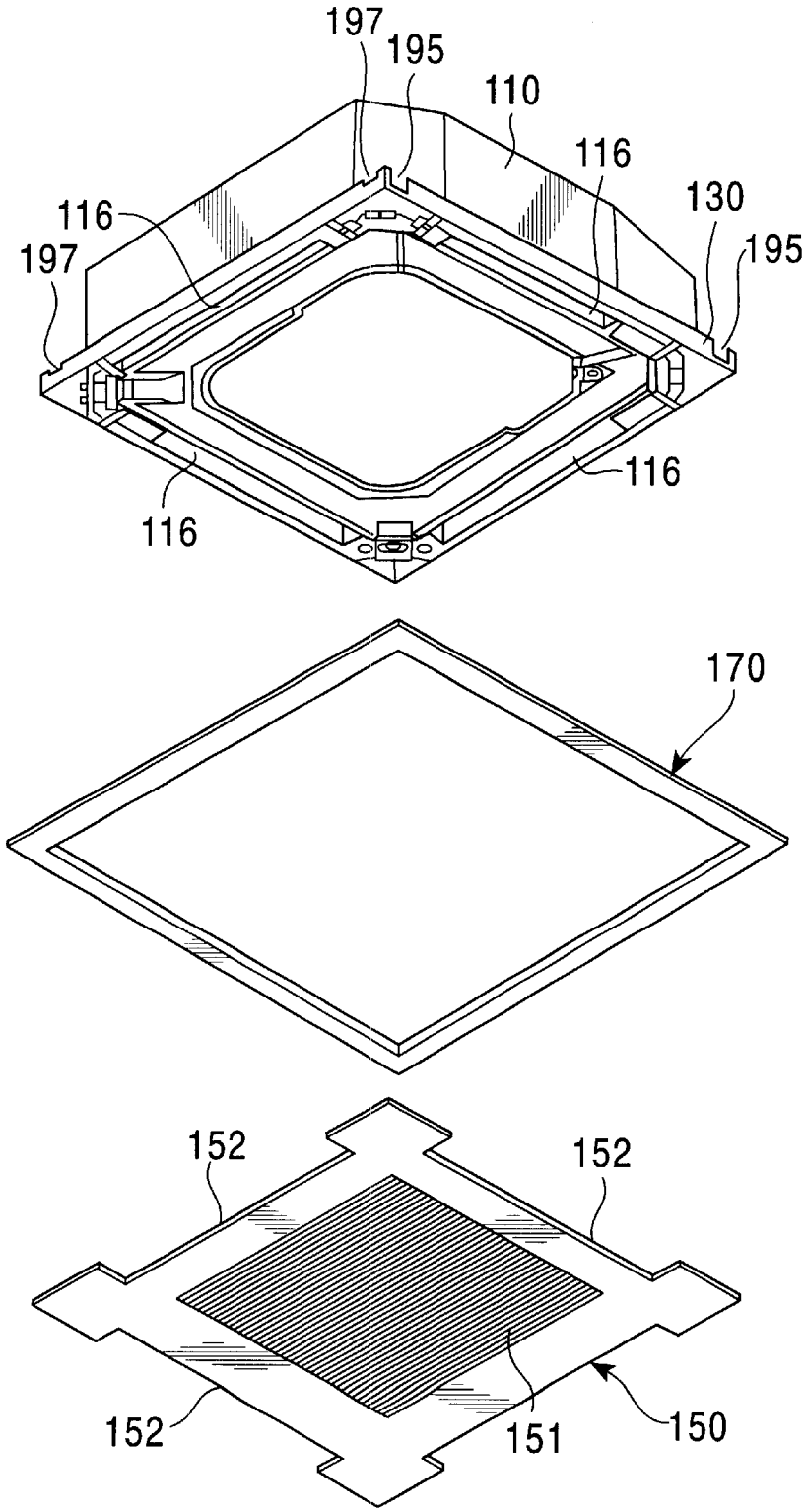
FIG. 4 is a perspective view of a case body, a suction grille, and a decorative frame in the air conditioner in accordance with the first embodiment, showing a state in which these elements are separated.

After the panel base 130 is installed to the case body 110, as shown in an exploded perspective view of FIG. 4, a suction grille 150 is installed to the panel base 130 so as to cover the frame inside. Also, a decorative panel 170 is fitted on the outside of the panel base 130. Both of the suction grille 150 and the decorative frame 170 are front panel elements, and these elements constitute a front panel.

Specifically, in the air conditioner 100, the front panel comprises the suction grille 150 and the decorative frame 170. The suction grille 150 is formed of an injection molded product, and at the central portion thereof is formed an air suction port 151 comprising a large number of slits communicating with the interior of the bell mouth 117 in the case body 110. Also, at four sides of the suction grille 150, there are formed air blow ports 152 communicating with the air ports 116 in the case body 110.

Figure 5:
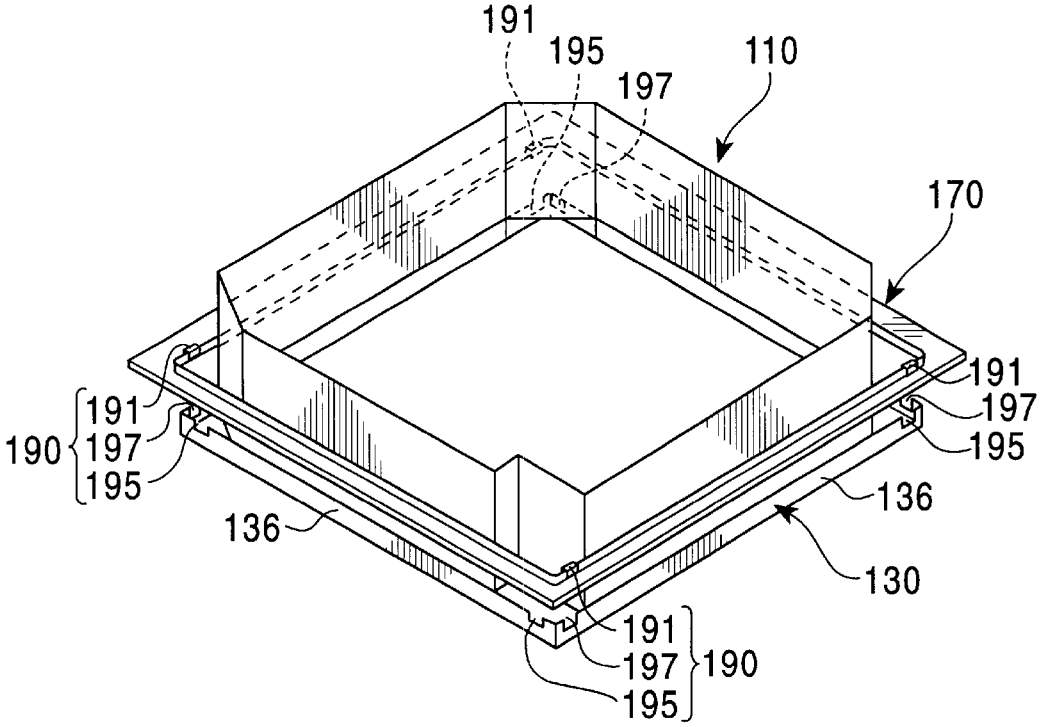
FIG. 5 is a perspective view showing a state in which the decorative frame is being installed to the panel base in the air conditioner in accordance with the first embodiment.
Figure 6:
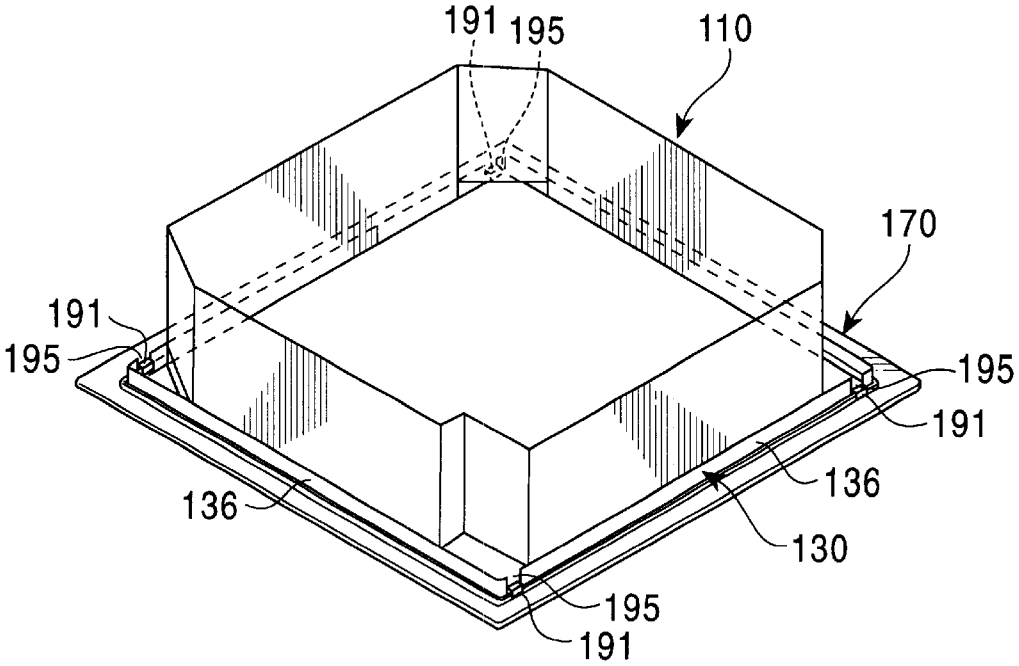
FIG. 6 is a perspective view showing a state in which the decorative frame has been installed to the panel base in the air conditioner in accordance with the first embodiment.

In the present invention, the decorative frame 170 can be set at a different height position according to the height space in the ceiling, and installation position changing means 190 is provided for this purpose. Referring first to FIGS. 5 and 6, in this first embodiment, the installation position changing means 190 comprises a combination of a hook 191 attached to the side of the decorative frame 170 and two kinds of grooves 195 and 197 with different depths, which are formed on the side of the panel base 130.

Figure 9:
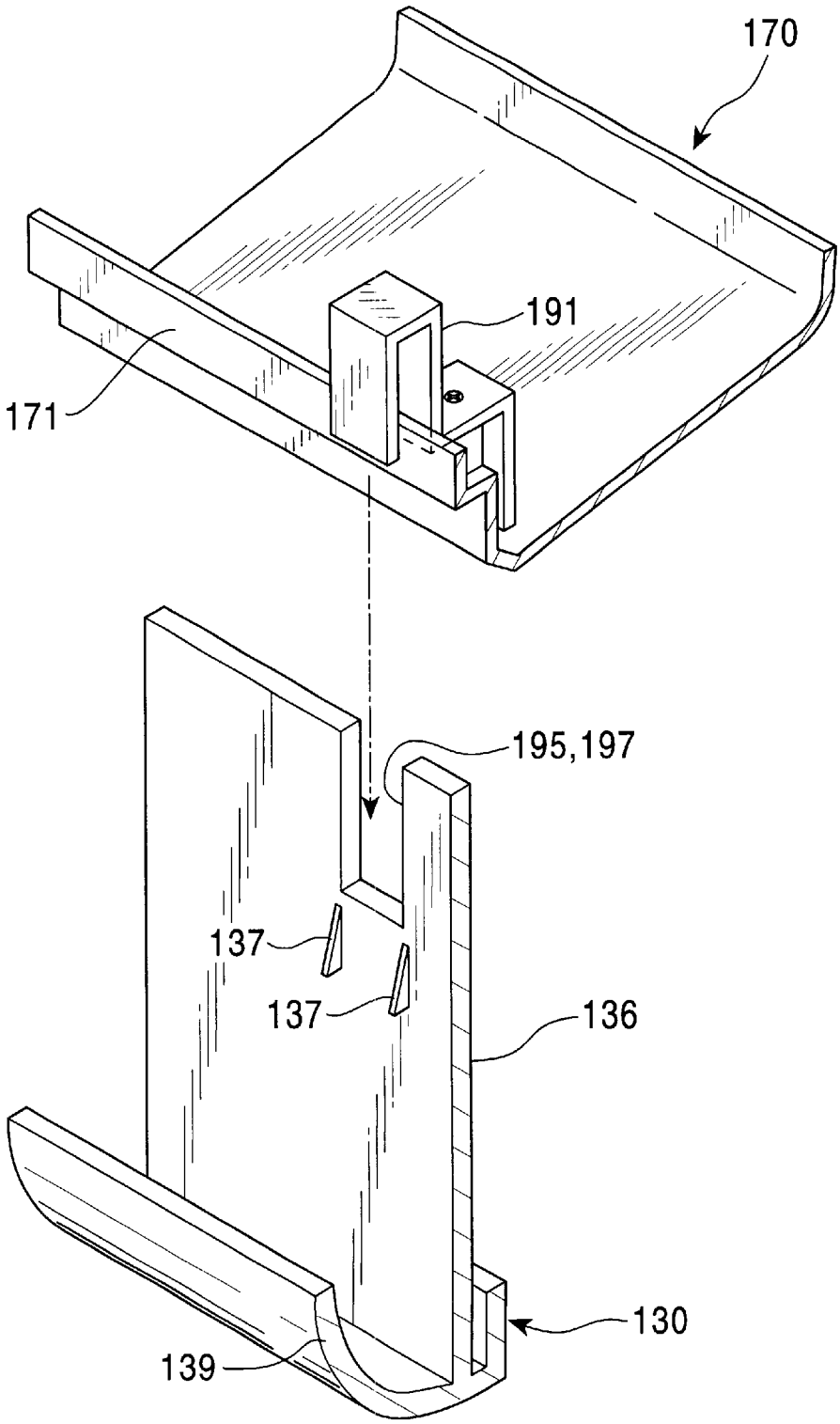
FIG. 9 is an exploded perspective view for illustrating looseness preventive means for the decorative frame in the air conditioner in accordance with the first embodiment.

The hook 191 is attached to an inside wall 171 of the decorative frame 170 so that the opening end side thereof faces downward, that is, in an inverse u shape (see FIG. 9). Although the decorative frame 170 has four sides, the hook 191 is attached to two sides opposing to each other. In this first embodiment, two hooks 191, 191 are attached at right and left end positions on one side.

Figure 7:
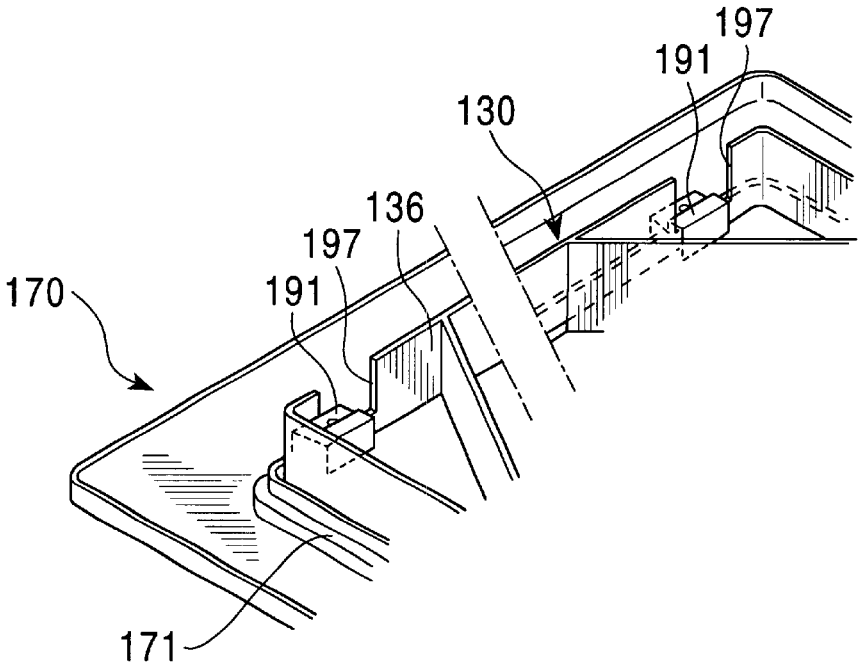
FIGS. 7 and 8 are enlarged perspective views of an essential part shown in FIG. 6.
Figure 8:
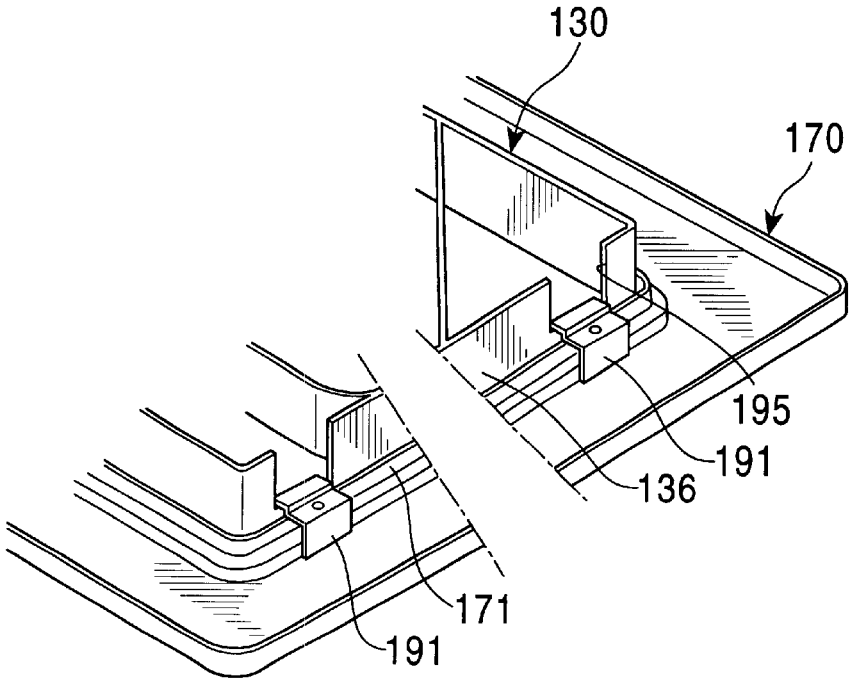

Contrarily, as shown in FIGS. 7 and 8, the grooves 195 and 197 are formed in a side wall 136 of the panel base 130. The side wall 136 is formed so as to rise up along the wall surface of the case body 110. In this case, the deeper first grooves 195 shown in FIG. 8 are arranged on two sides opposing to each other, and the shallower second grooves 197 shown in FIG. 7 are arranged on the other two sides opposing to each other.

Both of the first grooves 195 and the second grooves 197 are formed at two places at right and left ends of the side on which these grooves are to be formed, in response to the fact that two hooks 191, 191 are provided on a predetermined one side of the decorative frame 170 as described above.

Therefore, the decorative frame 170 is turned through 90° in the horizontal plane, and is inserted from the upside of the case body 110 as shown in FIG. 5. Then, the hooks 191 are engaged with the deeper first grooves 195 or the shallower second grooves 197. Thereby, as shown in FIG. 2, the decorative frame 170 can be set at lower position A or upper position B.

The position A is a position having almost the same height as the face of the suction grille 150. In the case where the height space in the ceiling has a height capable of fully containing the case body 110, the decorative frame 170 is set at the position A. At this time, the decorative frame 170 appears so as to be integral with the suction grille 150.

The position B is a position higher than the position A. In the case where the height space in the ceiling is limited, and a part of the lower portion of the case body 110 projects from the ceiling surface, the decorative frame 170 is set at the position B to prevent a gap from being developed between the decorative frame 170 and the ceiling plate.

In the actual installation work, the height space in the ceiling is measured, and the decorative frame 170 is set at either the position A or the position B according to the height space. Then, the case body 110 is hung from the ceiling slab 5 by using the hanging bolts 4. Subsequently, fine adjustment is made by using the hanging bolts 4 so that the decorative frame is at the same height as the ceiling plate.

In this first embodiment, in order to prevent looseness of the decorative frame 170 in the horizontal plane, ribs 137 are provided on the back face of the side wall 136 of the panel base 130 as shown in FIG. 9. These ribs 137 are disposed in a pair on the lower side of the groove bottom of the groove 195, 197 so as to be capable of contacting with both sides of the hook 191.

Preferably, the rib 137 has an inclined face such that the height increases toward the lower side, and is formed into a triangular shape as viewed from the side. In this case, the hook 191 can be slid smoothly in between the ribs 137, 137, and also both sides thereof is pushed by the ribs 137, 137, so that looseness of the decorative frame 170 in the horizontal plane can be prevented.

The aforementioned air deflector driving portion 133 is usually covered by the suction grille 150. However, when the suction grille 150 is removed to replace or clean a filter, the air deflector driving portion 133 is exposed, to be touched by a service or the like man inadvertently. This may causes improper engagement of gears.

In this embodiment, therefore, as shown in FIG. 10, the air deflector driving portion 133 is covered by a protective cover 141. This protective cover 141 is formed separately from the panel base 130, and is mounted detachably to the panel base 130 by using well-known engagement means such as an engagement claw.

Figure 11:
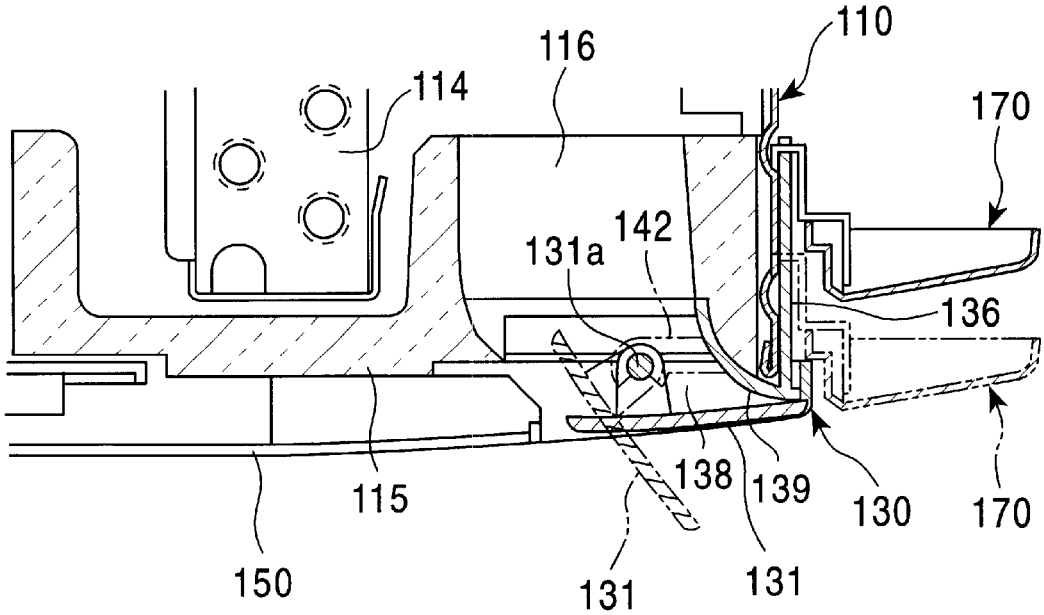
FIG. 11 is an enlarged sectional view of an air blow portion in the air conditioner in accordance with the first embodiment.

Also, as shown in FIG. 11, the panel base 130 is provided with an air blow opening 138 communicating with the air port 116 of the case body 110. In this embodiment, the opening side wall 139 thereof is formed so as to enter from the lower end of the side wall 136 of the panel base 130 into the air port 116 of the case body 110, so that a substantially V-shaped space is provided between the side wall 136 and the opening side wall 139.

By tightly inserting the lower end of an expanded synthetic resin (heat insulating material) forming the air port 116, the heat insulating property of the air blow portion is improved, by which dew condensation caused by the leakage of cool air is prevented. Also, by forming the opening side wall 139 into a curved shape so as to be curved toward the side wall lower end side of the panel base 130, the air blow resistance is reduced.

Also, as shown in FIG. 11, the air deflector 131 is provided with a rotating shaft 131*a* at the center on the back face side in addition to both sides. Corresponding to this, at the center of the opening side wall 139, there is provided a bearing plate 142 for rotatably supporting the rotating shaft 131*a*, whereby the intermediate portion of the air deflector 131 is prevented from being deflected. This support construction is effective especially when the air deflector 131 is long.

In the above-described first embodiment, two hooks 191 and two grooves 195 (197) are provided on a predetermined one side on the side of the panel base 130 and on the side of the decorative frame 170, respectively. However, one hook 191 and one groove 195 (196) may be provided at the center on the side.

The following is a description of a second embodiment. The second embodiment differs from the first embodiment in the installation position changing means for position change of the decorative frame with respect to the panel base. For the case body 110 and the suction grille 150 used in the first embodiment, the explanation is omitted because these elements need not be changed in applying to the second embodiment.

Figure 12:
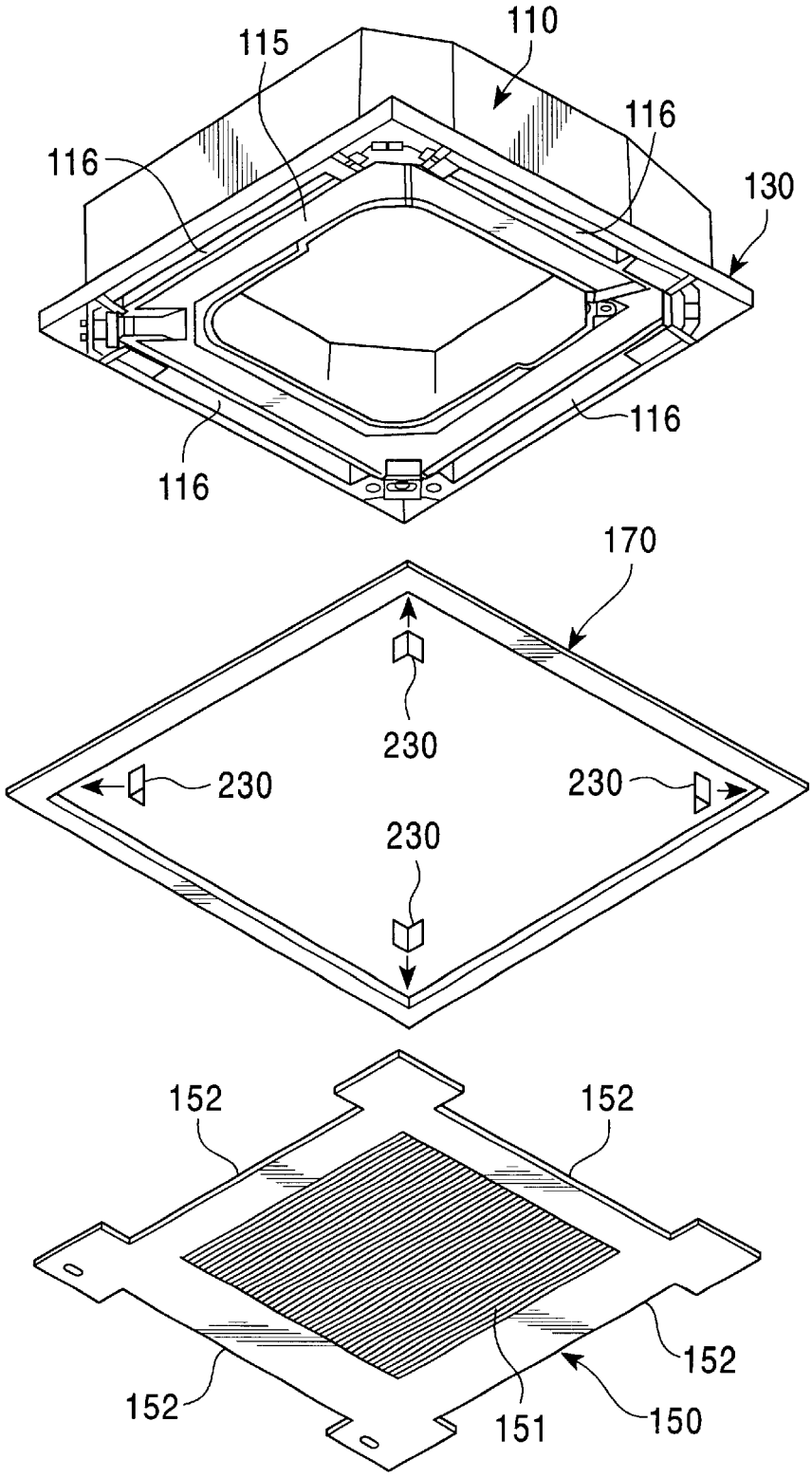
FIG. 12 is a perspective view of a case body, a suction grille, and a decorative frame in an air conditioner in accordance with a second embodiment, showing a state in which these elements are separated as shown in FIG. 4.
Figure 13:
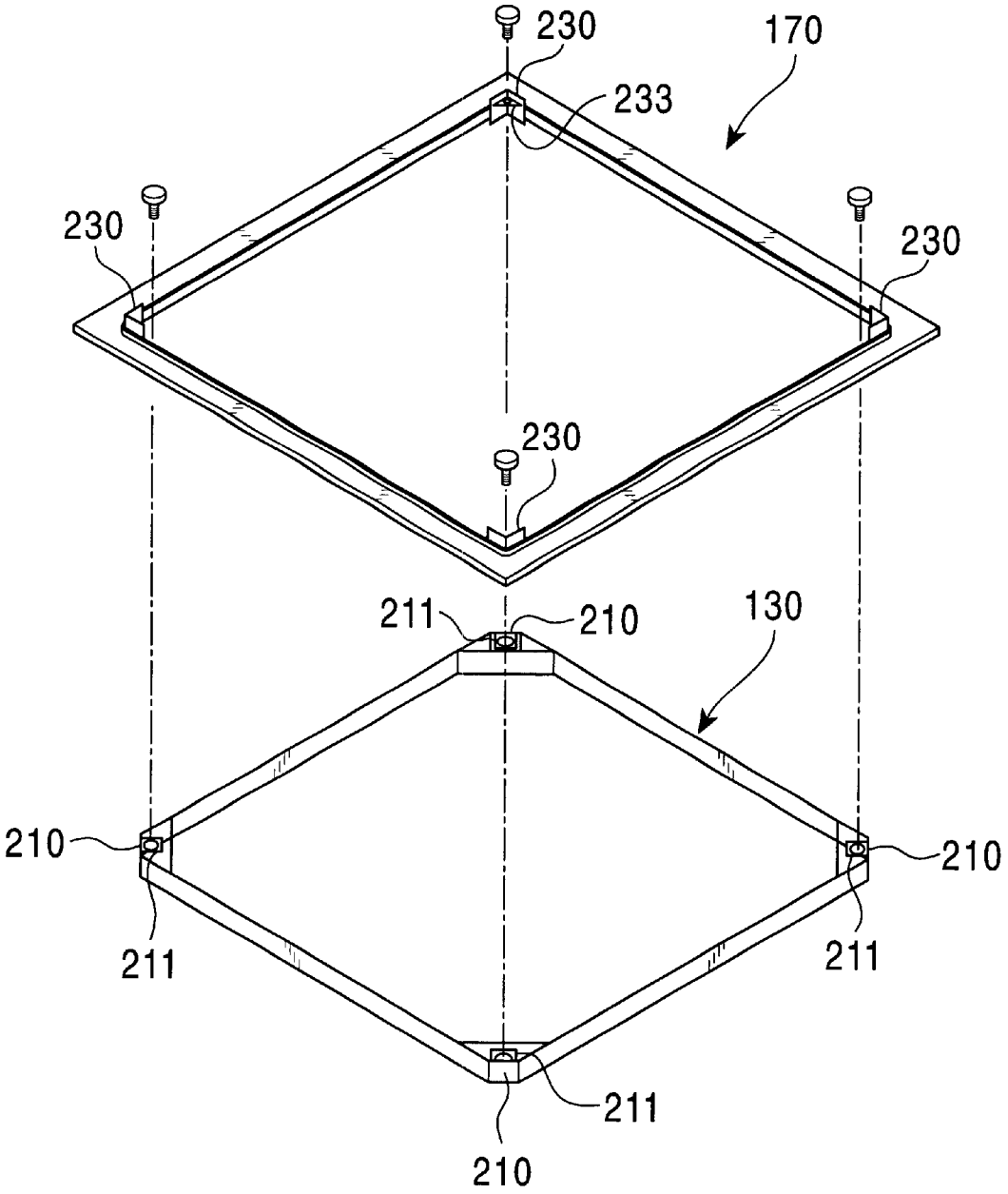
FIG. 13 is a perspective view of a suction grille and a decorative frame in the air conditioner in accordance with the second embodiment.

FIG. 12 is an exploded perspective view of an air conditioner in accordance with the second embodiment, which is drawn in the same way as FIG. 4 having been explained before. FIG. 13 is a perspective view of a panel base 130 and a decorative frame 170 extracted from FIG. 12, but the positional relationship is vertically opposite to FIG. 12. Also, in FIG. 13, for the panel base 130, only the skeleton thereof is drawn schematically, but it should be understood that as in the first embodiment, the panel base 130 is mounted with the air deflectors 131 and the driving portion 133 therefore.

According to the installation position changing means of the second embodiment, a corner cut portion 210 is formed at each corner of the panel base 130, and also four corner members 230, which are attached to the corner cut portions 210, are used to make the height position of the decorative frame 170 changeable. The corner cut portion means a portion at which a square corner (corner portion) is cut to a slant face of, for example, 45°.

Figure 14:
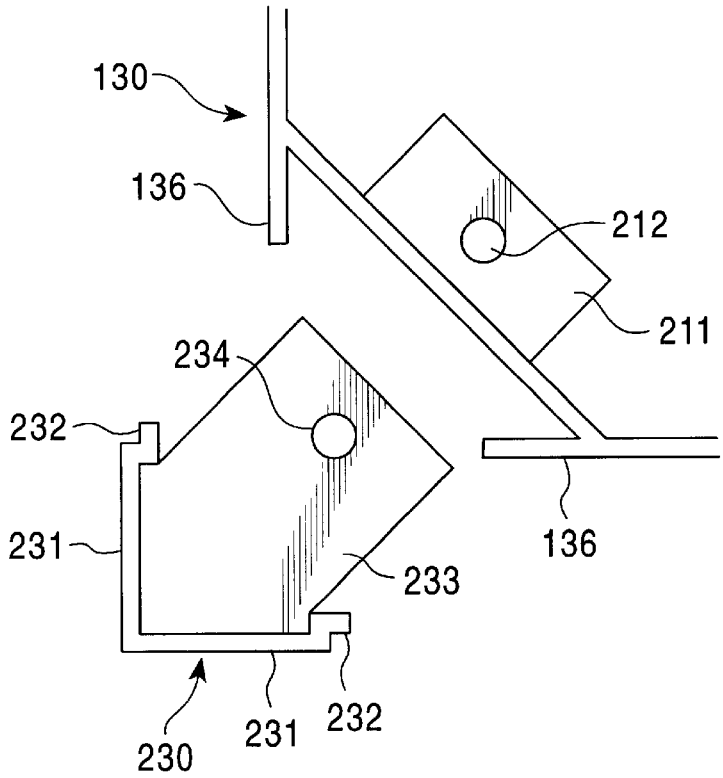
FIG. 14 is a plan view of a corner cut portion and a corner member of a panel base in the air conditioner in accordance with the second embodiment, showing a state in which these elements are separated.

The corner member 230 has a shape such as to compensate the corner cut portion 210. Specifically, the corner cut portion 210 becomes the original right-angled corner portion by installing the corner member 230. As shown in FIG. 14, the corner member 230 is provided with right and left side plates 231, 231 bent through 90 degrees, and the corner of the panel base 130 is returned to a right angle by these side plates 231, 231 (see FIG. 15).

Figure 15:
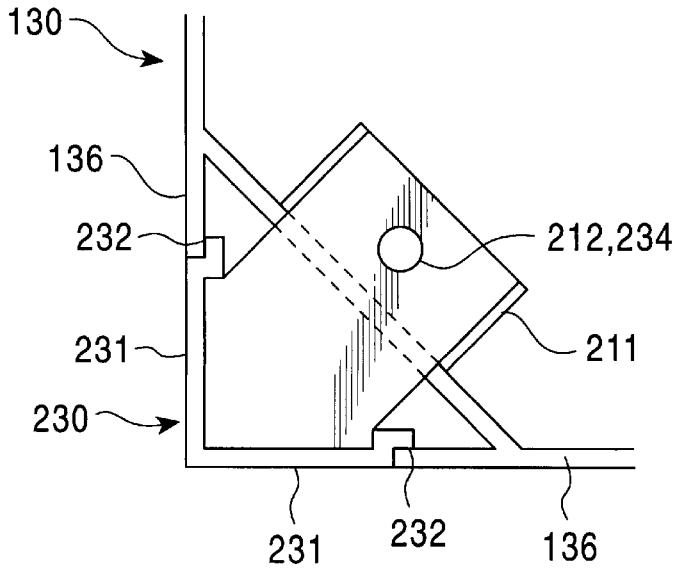
FIG. 15 is a plan view showing a state in which the corner member is attached to the corner cut portion of the base panel shown in FIG. 14.

When the corner member 230 is attached to the corner cut portion 210, it is desirable to make the side face of the corner member 230 flush with the side face of the panel base 130. For this purpose, the side wall 136 of the panel base 130 is caused to project by a predetermine length into the corner cut portion 210, and an L-shaped step portion 232 engaging with the inside face of the side wall 136 is formed at the end portion of each of the side plates 231 of the corner member 230, whereby the step portion 232 is engaged with the end portion of the side wall 136 as shown in FIG. 15.

Figure 16:
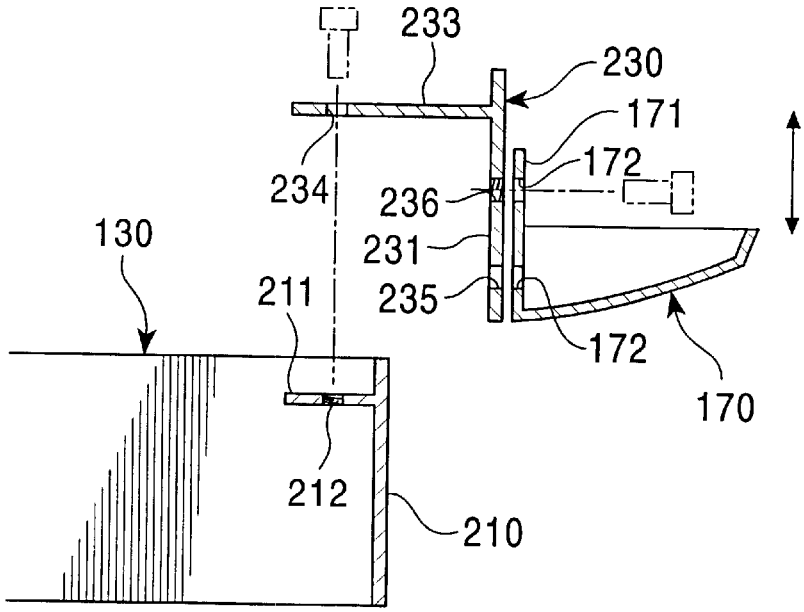
FIG. 16 is a sectional view corresponding to FIG. 14.

According to the second embodiment, the corner member 230 is fixed to the corner cut portion 210 of the panel base 130 in the manner described below. As shown in a sectional view of FIG. 16, the corner member 230 has a horizontally extending attachment plate 233 on the inside held between the right and left side plates 231, 231, and the attachment plate 233 is formed with a screw insertion hole 234 at a predetermined place.

Figure 17:
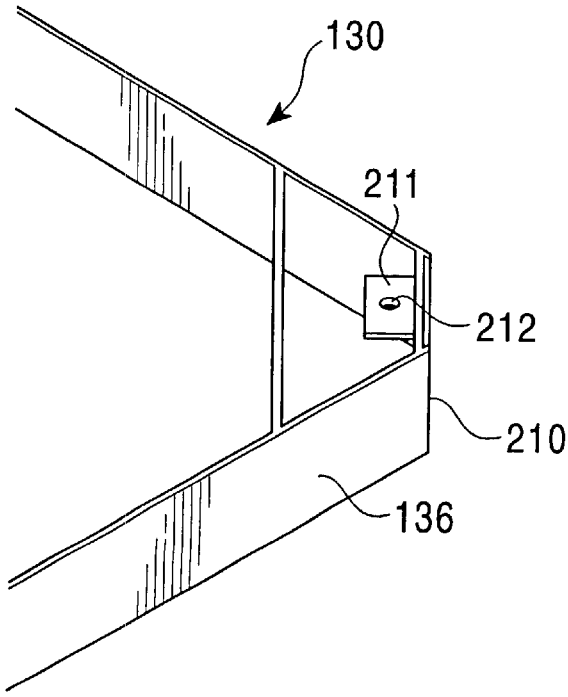
FIG. 17 is a perspective view of the corner cut portion.

On the other hand, as shown in FIG. 17 as well, on the side of the corner cut portion 210 of the panel base 130, there is provided a fixing plate 211 that extends horizontally as the attachment plate 233 does. The fixing plate 211 is formed with a screw insertion hole 212 that is aligned coaxially with the screw insertion hole 234 in the attachment plate 233 when the corner member 230 is set at a proper installation position of the corner cut portion 210.

Therefore, after the attachment plate 233 is arranged at a proper position of the fixing plate 211, a screw is inserted into the screw insertion holes 234 and 212 to fix the attachment plate 233 to the fixing plate 211 with the screw. Thereby, the corner member 230 is fixed to the corner cut portion 210 of the panel base 130.

The side plate 231 of the corner member 230 is formed with two screw insertion holes 235 and 236 at two places with a different height. Contrarily, the inside wall 171 of the decorative frame 170 is formed with at least one screw insertion hole 172 with a predetermined height. In this embodiment, the inside wall 171 is formed with two screw insertion holes 172 at the same interval as that of the screw insertion holes 235 and 236.

Therefore, by aligning both of the screw insertion holes 172, 172 in the decorative frame 170 with the screw insertion holes 235 and 236 in the corner member 230 and by screwing the decorative frame 170 to the corner member 230, the decorative frame 170 is set at, for example, the position A in FIG. 2.

Contrarily, by shifting the decorative frame 170 upward and aligning the lower screw insertion hole 172 therein with the upper screw insertion hole 236 in the corner member 230 and by screwing the decorative frame 170 to the corner member 230, the decorative frame 170 may be set at the position B in FIG. 2.

The alignment of these screw insertion holes is arbitrary. For example, the configuration may be such that when the upper screw insertion hole 172 in the decorative frame 170 is aligned with the lower screw insertion hole 235 in the corner member 230, the decorative frame 170 may be set at the position A in FIG. 2.

The following is a description of a third embodiment of the present invention. According to the third embodiment, by fitting the decorative frame 170 onto the panel base 130 from the downside, the height position thereof can be adjusted. In this third embodiment as well, the explanation of the case body 110 and the suction grille 150 is omitted because these elements need not be changed in applying to the third embodiment.

Figure 18:
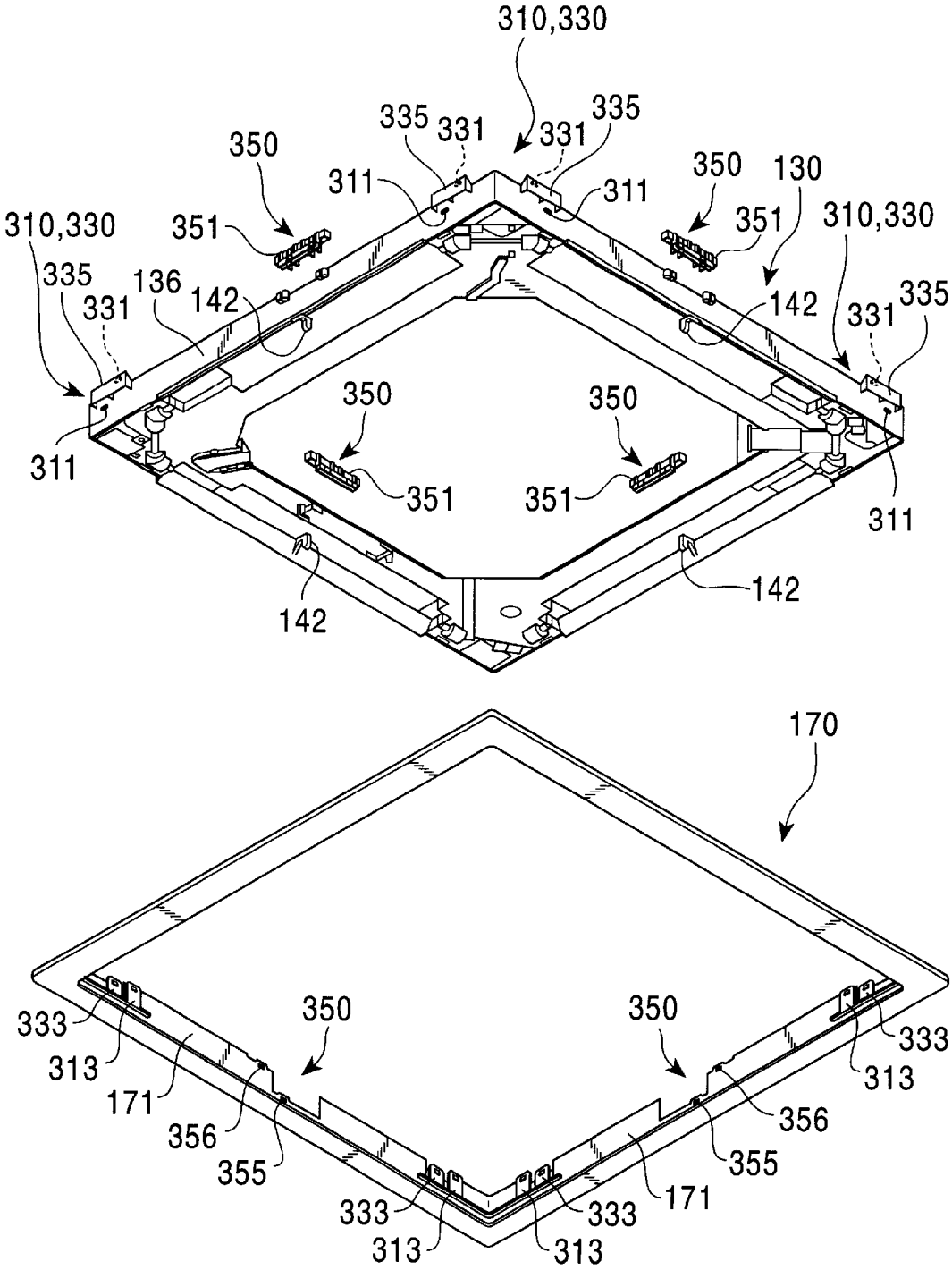
FIG. 18 is a perspective view of a panel base and a decorative frame in an air conditioner in accordance with a third embodiment, showing a state in which these elements are separated.

FIG. 18 is a perspective view of the panel base 130 and the decorative frame 170 in the air conditioner in accordance with the third embodiment, showing a state in which these elements are separated. In the third embodiment, there are provided first engagement means 310 which engages at a lower height position (the position A in FIG. 2) when the decorative frame 170 is fitted onto the panel base 130 from the downside on the room side, and second engagement means 330 which engages at a higher height position (the position B in FIG. 2).

When the decorative frame 170 is fitted onto the panel base 130, by turning the decorative frame 170 through 90 degrees in the horizontal plane, either the first engagement means 310 or the second engagement means 330 is selected.

Each of the engagement means 310 and 330 comprises a combination of a protrusion provided on the side wall 136 of the panel base 130 and an elastically deformable engagement member provided on the inside wall 171 of the decorative frame 170. These elements are provided on each of four sides of the panel base 130 and the decorative frame 170 so as to prevent positional interference with each other.

Figure 19:
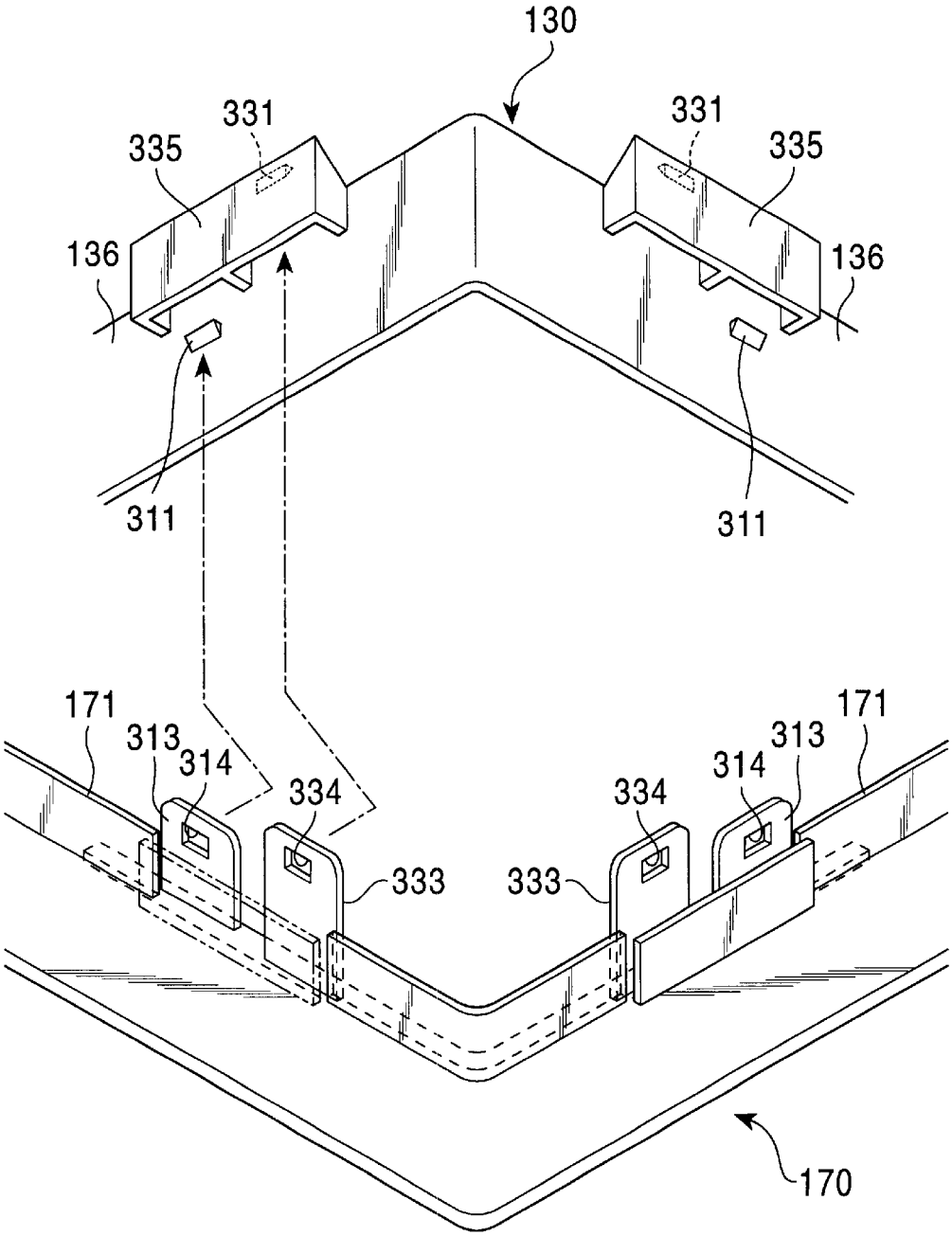
FIG. 19 is an enlarged perspective view of an essential part for illustrating first and second engagement means in the air conditioner in accordance with the third embodiment.

Referring now to FIG. 19, the first engagement means 310 comprises a combination of a protrusion 311 provided on the side wall 136 of the panel base 130 and an engagement member 313 provided on the inside wall 171 of the decorative frame 170. Similarly, the second engagement means 330 comprises a combination of a protrusion 331 provided on the side wall 136 of the panel base 130 and an engagement member 333 provided on the inside wall 171 of the decorative frame 170.

The protrusion 311 of the first engagement means 310 is provided directly on the side wall 136 of the panel base 130. On the other hand, the protrusion 331 of the second engagement means 330 is provided at a position obliquely above the protrusion 311 and separate from the side wall 136 of the panel base 130.

Specifically, the side wall 136 of the panel base 130 has a portal frame 335 at a position at which the protrusion 331 is to be located, and the protrusion 331 is provided on the inside face of the portal frame 335, that is, on the face facing the side wall 136 of the panel base 130. The protrusion 331 is arranged at the position higher than the protrusion 311 as viewed from the lower room side and moreover at a position at which the protrusion 331 is not superposed with the protrusion 311 in the upward and downward directions.

The engagement member 313 of the first engagement means 310 and the engagement member 333 of the second engagement means 330 are formed with fit holes 314 and 334 fitting on the corresponding protrusions 311 and 331, respectively. The engagement member 313 and the engagement member 333 are arranged so as to be adjacent to each other, but one engagement member 313 is arranged at an outside position as viewed from the inside wall 171 of the decorative frame 170 in comparison with the other engagement member 333.

Specifically, when the decorative frame 170 is fitted onto the panel base 130, the engagement member 313 of the first engagement means 310 comes into contact with the side wall 136 of the panel base 130. Contrarily, the engagement member 333 of the second engagement means 330 slides into the portal frame 335, so that a gap is developed between the engagement member 333 and the side wall 136.

Figure 20:
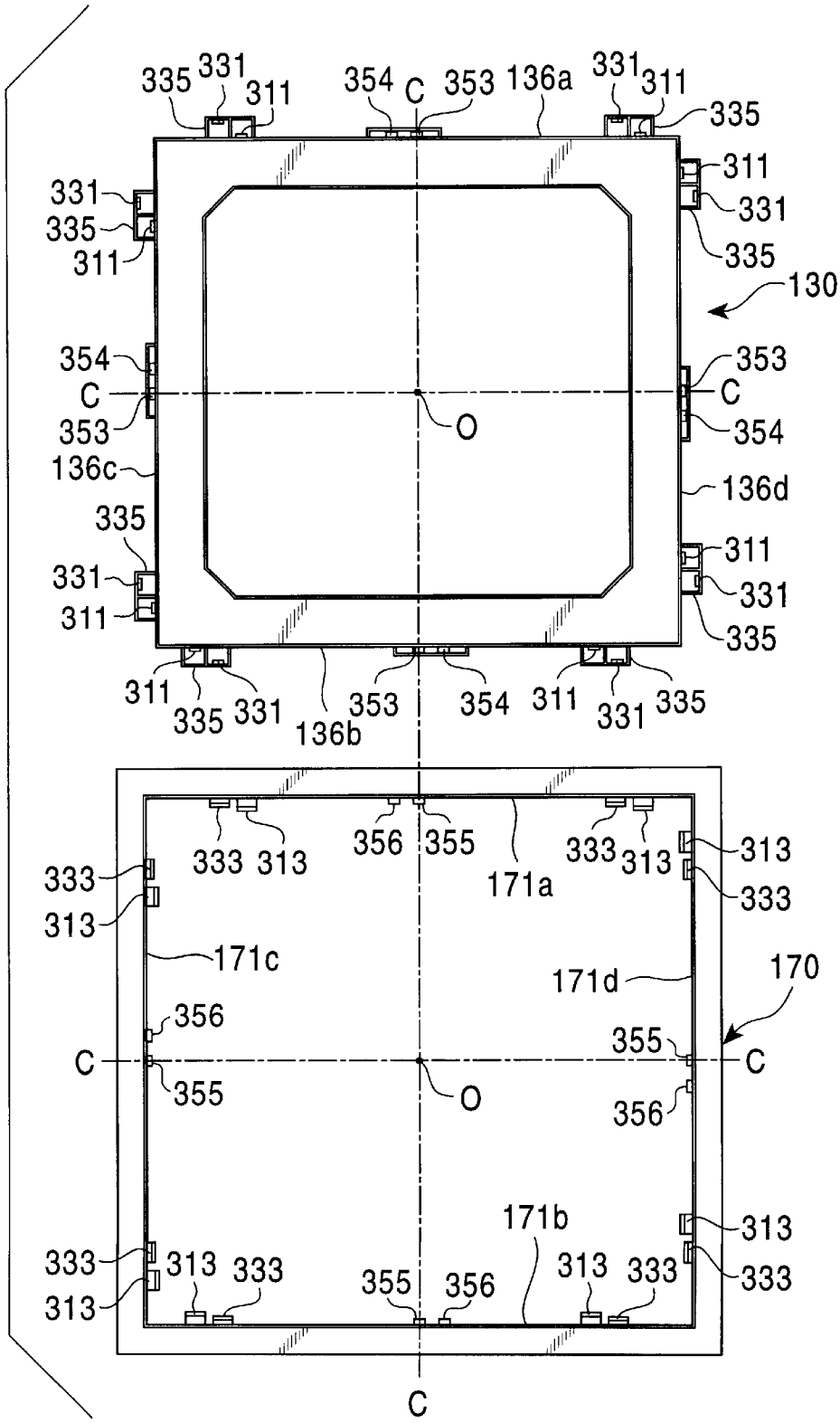
FIG. 20 is a plan view of the panel base and the decorative frame in the air conditioner in accordance with the third embodiment, showing these elements disposed in parallel, respectively.

Referring additionally to FIG. 20 showing plan views of the panel base 130 and the decorative frame 170, the engagement means 310 and 330 are provided at two places at the right and left ends of each side. Specifically, for the panel base 130, the protrusion 311 and the protrusion 331 are arranged adjacently at one end of each side, and the protrusion 311 and the protrusion 331 are arranged adjacently at the other end.

In this case, the distance between one protrusion 311 and the other protrusion 311 and the distance between one protrusion 331 and the other protrusion 331 are equal, but the protrusions 311, 311 and the protrusions 331, 331 are arranged at positions asymmetrical with respect to the centerline C—C of the panel base 130.

Also, the arrangement sequence of the protrusion 311 and the protrusion 331 is different between on opposing two sides 136*a* and 136*b* and on the other opposing two sides 136*c* and 136*d*. The arrangement sequence of the protrusions on the sides 136*a* and 136*b* is symmetrical with respect to the center point O of the panel base 130. Similarly, the arrangement sequence of the protrusions on the sides 136*c* and 136*d* is symmetrical with respect to the center point O.

Now, the arrangement sequence of the protrusions on the side 136*a* and the arrangement sequence of the protrusions on the side 136*c* will be explained. In FIG. 20, when the arrangement sequence of the protrusions is viewed counterclockwise, the arrangement sequence is 311→331→311 →331 on the side 136*a*, while the arrangement sequence is 331→331→311→311 on the side 136*c*.

Also, on the sides 136*a* and 136*b*, the positions of the protrusions are wholly shifted to the clockwise side with respect to the centerline C—C, while on the sides 136*c* and 136*d*, the positions of the protrusions are wholly shifted to the counterclockwise side with respect to the centerline C—C.

For the decorative frame 170, the engagement member 313 of the first engagement means 310 and the engagement member 333 of the second engagement means 330 are arranged adjacently at one end of each side, and similarly the engagement member 313 and the engagement member 333 are arranged adjacently at the other end.

In this case, the distance between one engagement member 313 and the other engagement member 313 and the distance between one engagement member 333 and the other engagement member 333 are equal, but the engagement members 313, 313 and the engagement members 313, 313 are arranged at positions asymmetrical with respect to the centerline C—C of the panel base 130.

Also, the arrangement sequence of the engagement member 313 and the engagement member 333 is different between on opposing two sides 171*a* and 171*b* and on the other opposing two sides 171*c* and 171*d*. The arrangement sequence of the engagement members on the sides 171*a* and 171*b* is symmetrical with respect to the center point 0 of the decorative frame 170. Similarly, the arrangement sequence of the engagement members on the sides 171*c* and 171*d* is symmetrical with respect to the center point O.

Now, the arrangement sequence of the engagement members on the side 171*a* and the arrangement sequence of the protrusions on the side 171*c* will be explained. In FIG. 20, when the arrangement sequence of the engagement members is viewed counterclockwise, the arrangement sequence is 313→333 →313→333 on the side 171*a*, while the arrangement sequence is 333→313→333→313 on the side 171*c*.

Also, like the panel base 130, on the sides 171*a* and 171*b*, the positions of the engagement members are wholly shifted to the clockwise side with respect to the centerline C—C, while on the sides 171*c* and 171*d*, the positions of the engagement members are wholly shifted to the counterclockwise side with respect to the centerline C—C.

In the third embodiment, in addition to the above-described first and second engagement means 310 and 330, third engagement means 350 is further provided to hold the central portion of the decorative frame 170. This third engagement means 350 is formed of four frame holding members 351 attached to the central portion on each side of the panel base 130 and two engagement holes 355 and 356 formed at the central portion of each side of the decorative frame 170.

Figure 21:
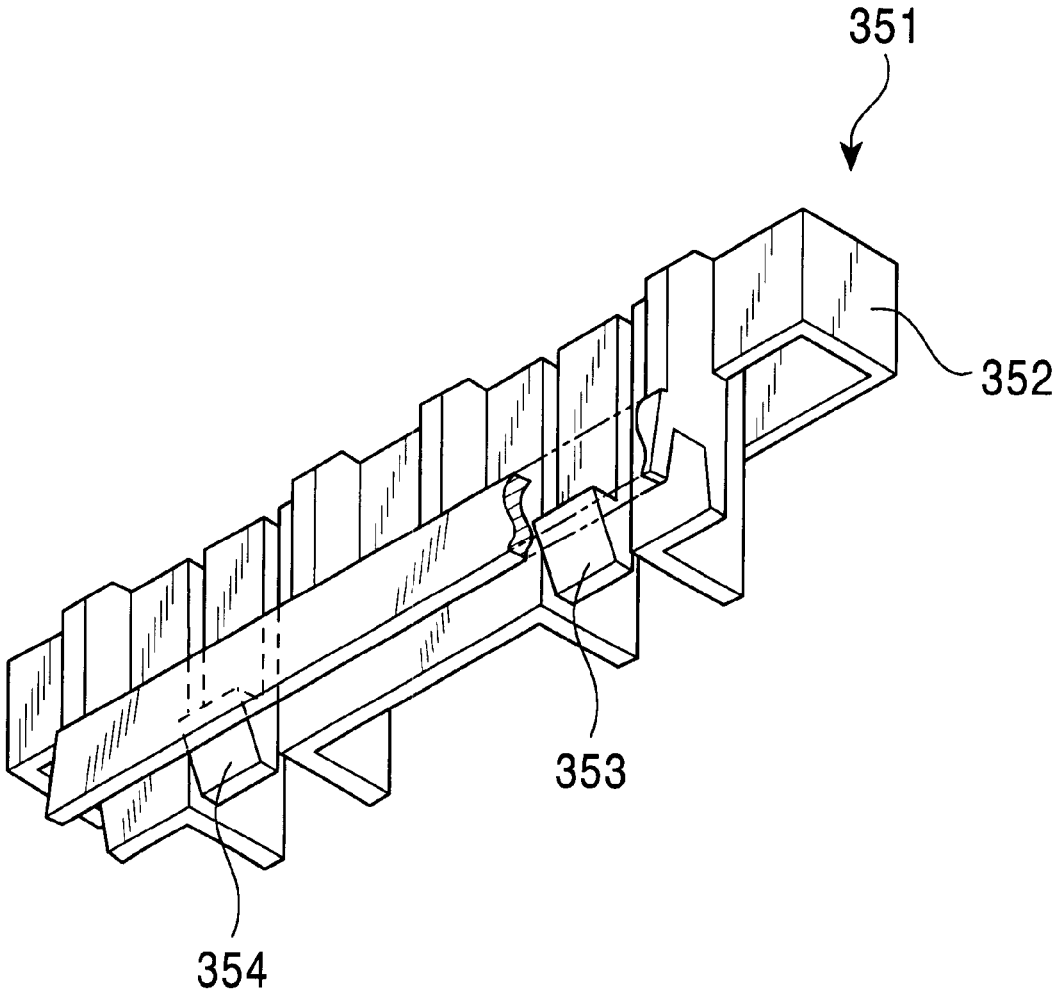
FIG. 21 is a perspective view of a frame holding member configuring third engagement means in the air conditioner in accordance with the third embodiment.
Figure 24:
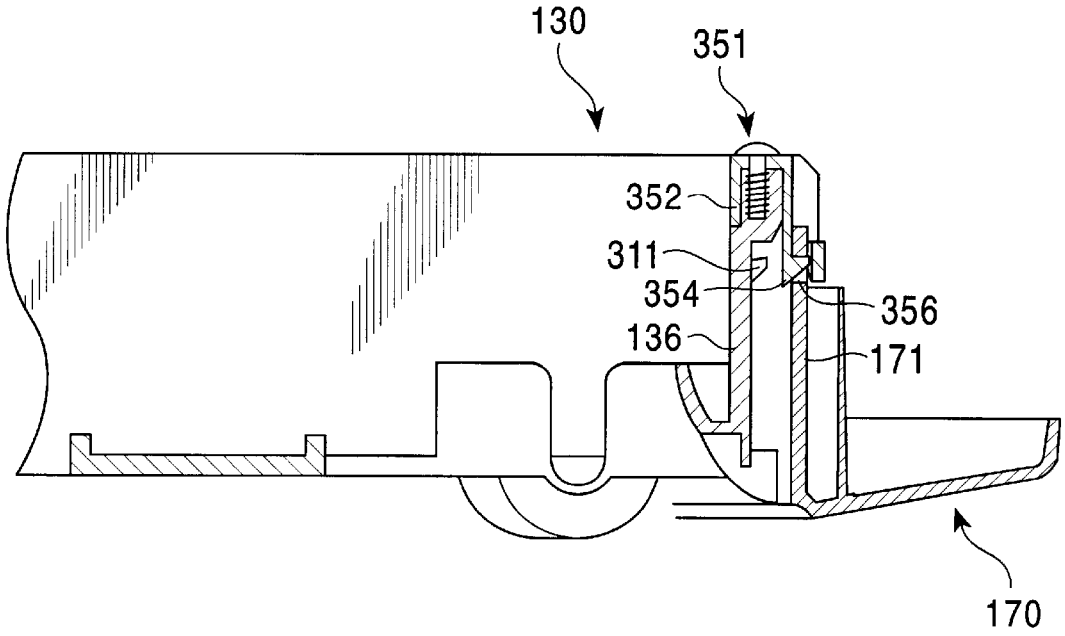
FIG. 24 is a sectional view showing an engagement state of the third engagement means at the time when the first engagement means is engaged.

As shown in FIGS. 21 and 24, the frame holding member 351 has a base portion 352 screwed to the upper edge of the side wall 136 of the panel base 130, and the base portion 352 is provided with two engagement claws 353 and 354 facing downward. The engagement claws 353 and 354 are located at the same height position as the protrusion 311 of the first engagement means 310, and are arranged in parallel at a predetermined interval at that height position.

In this case, as shown in FIG. 20, the one first engagement claw 353 is located on the centerline C—C of the panel base 130, and the other second engagement claw 354 is shifted from the centerline C—C. Specifically, as viewed from the center point O, the second engagement claw 354 is located on the left-hand side from the centerline C—C on the sides 136*a* and 136*b*, and is located on the right-hand side from the centerline C—C on the sides 136*c* and 136*d*.

Of the two engagement holes 355 and 356 formed in the decorative frame 170, the first engagement hole 355 is located on the centerline C—C. The other second engagement hole 356 is located at a higher position than the first engagement hole 355, and is shifted from the centerline C—C. Like the aforementioned second engagement claw 354, the second engagement hole 356 is, as viewed from the center point O, located on the left-hand side from the centerline C—C on the sides 171*a* and 171*b*, and is located on the right-hand side from the centerline C—C on the sides 171*c* and 171*d*.

Next, the operation of the third embodiment will be explained. First, as shown in FIG. 20, the decorative frame 170 is fitted onto the panel base 130 from the downside with the side 136*a* and the side 171*a*, the side 136*b* and the side 171*b*, the side 136*c* and the side 171*c*, and the side 136*d* and the side 171*d* being aligned with each other, by which the decorative frame 170 is set at the position A in FIG. 2.

Figure 22:
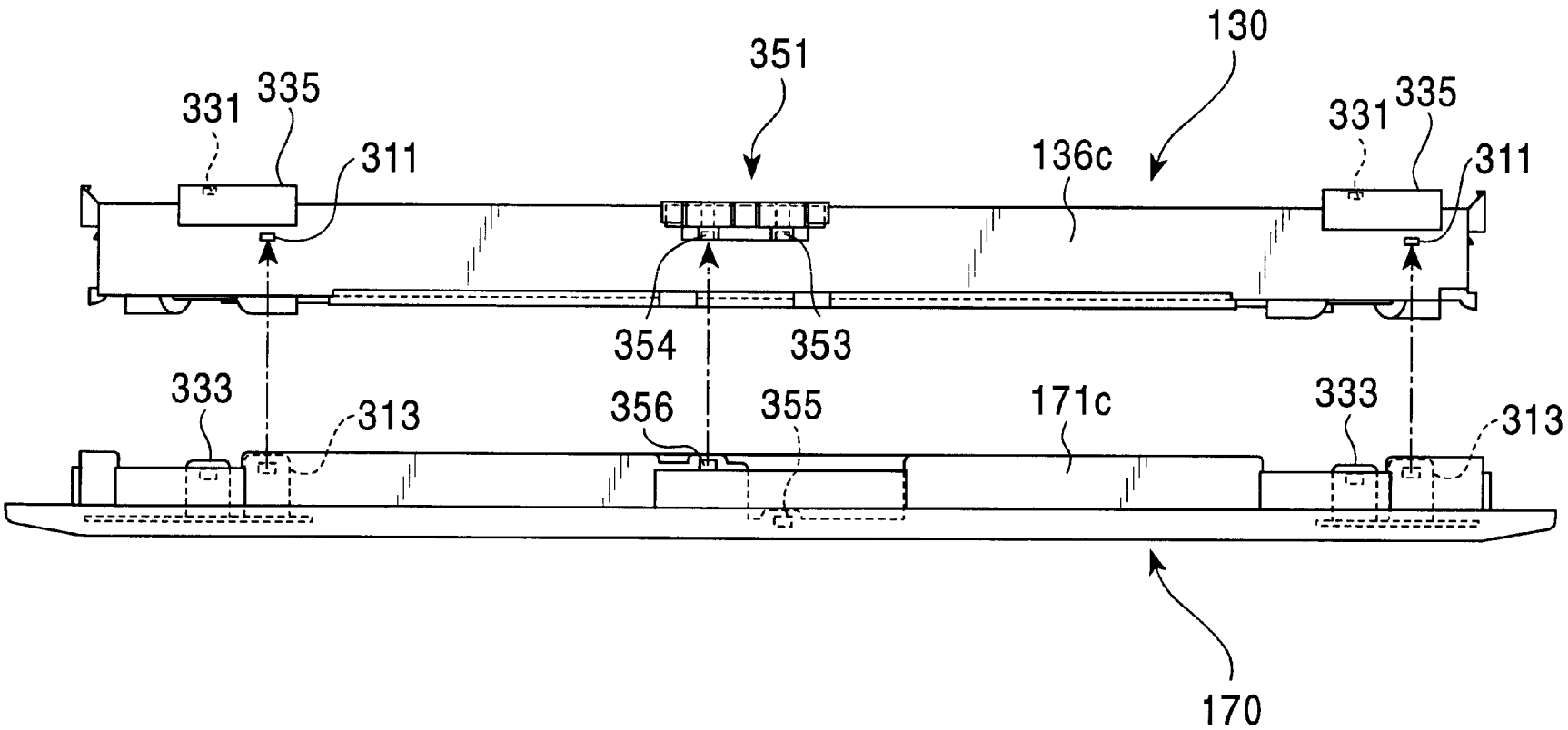
FIG. 22 is a side view showing a corresponding relation between the panel base and the decorative frame in the state shown in FIG. 20.
Figure 23:
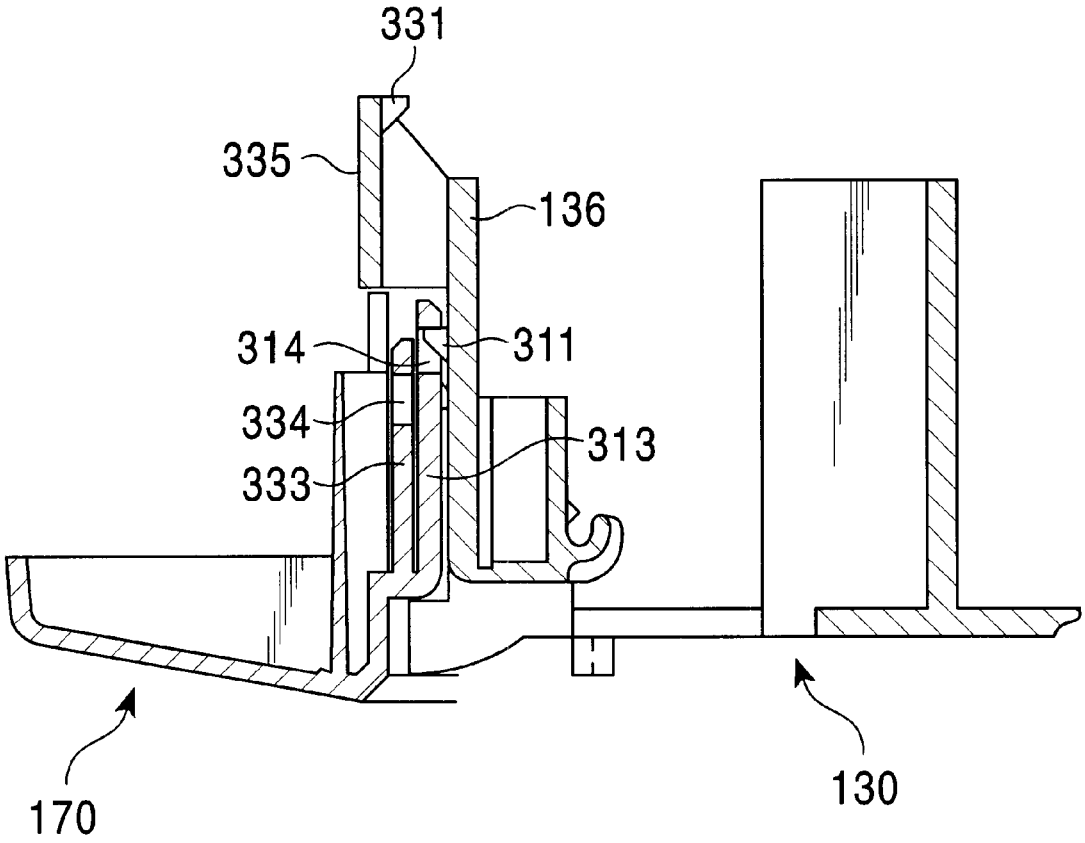
FIG. 23 is a sectional view showing an engagement state of the first engagement means.

FIG. 22 shows a corresponding relation between the side 136*c* and the side 171*c* at this time. As can be seen from this figure, the protrusion 311 and the engagement member 313 of the first engagement means 310, the protrusion 331 and the engagement member 333 of the second engagement means 330, and the first engagement claw 353 and the first engagement hole 355 of the third engagement means 350 correspond to each other.

By pushing up the decorative frame 170 in this state, the protrusion 311 of the first engagement means 310 is engaged with the engagement member 313 before the protrusion 331 of the second engagement means 330 is engaged with the engagement member 333. Also, for the third engagement means 350, the second engagement claw 354 is fitted into the upper second engagement hole 356 before it is fitted into the lower first engagement hole 355 (see FIG. 24). Thus, the decorative frame 170 is set at the position A in FIG. 2.

Figure 25:
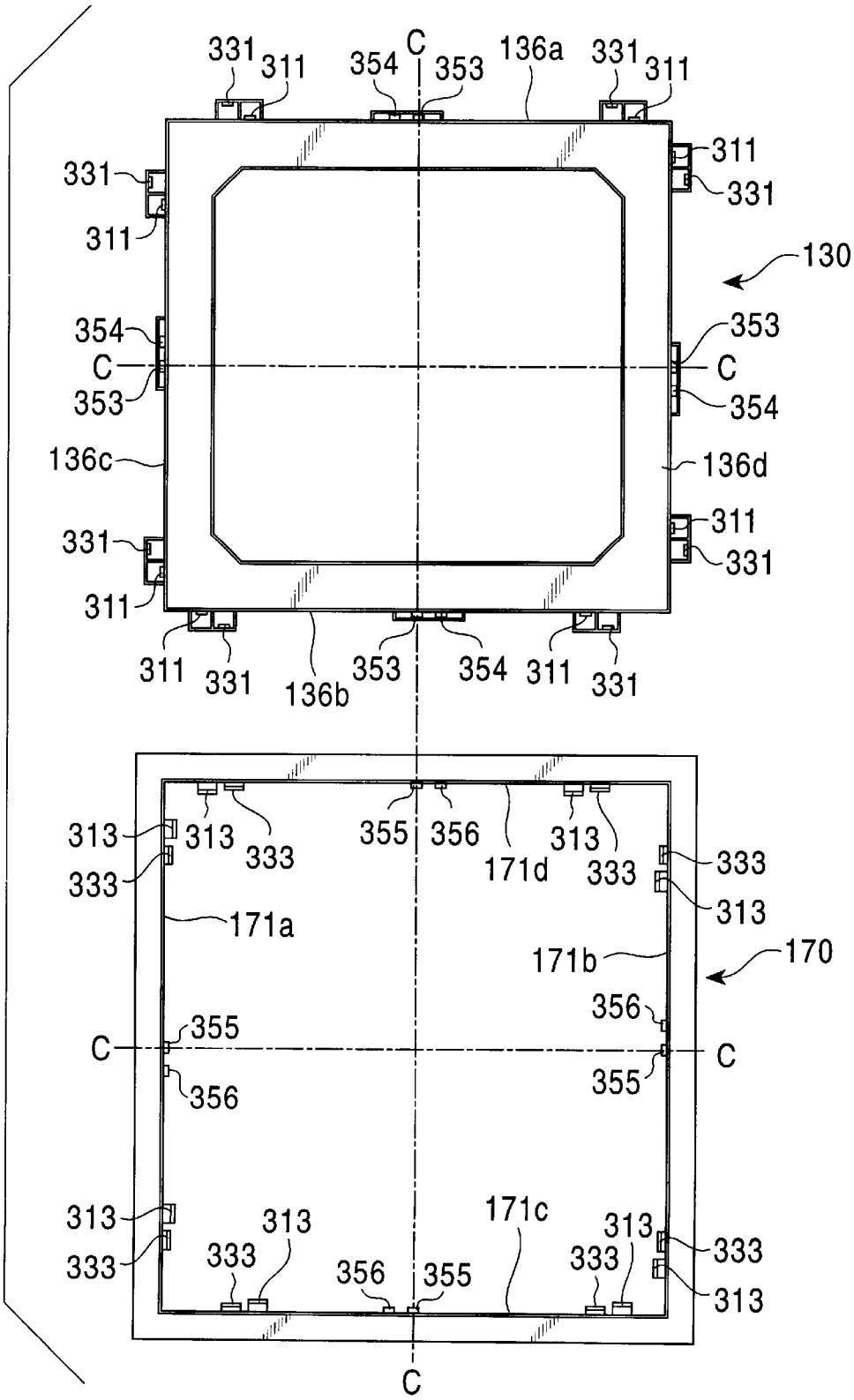
FIG. 25 is a plan view showing a state in which the decorative frame is turned through 90° from the state shown in FIG. 20 and arranged together with the panel base.
Figure 26:
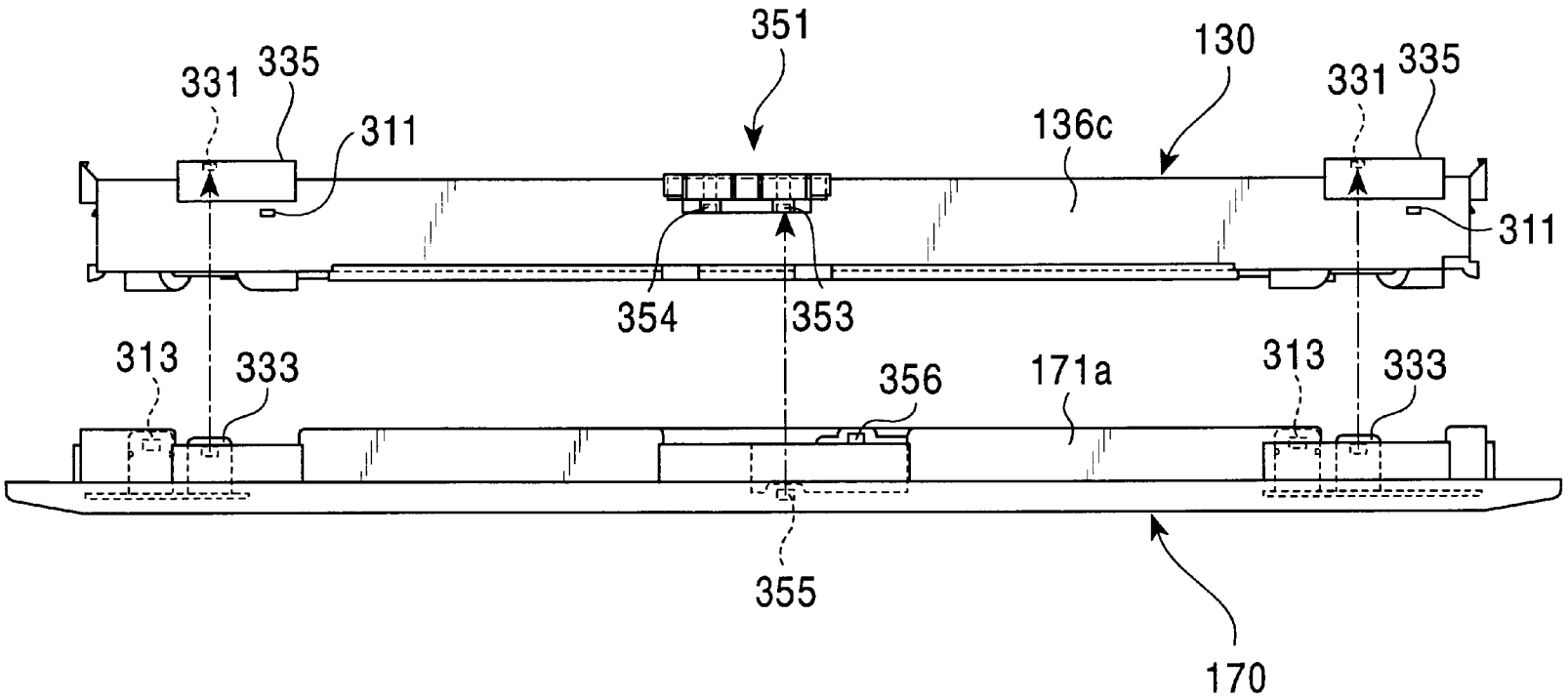
FIG. 26 is a side view showing a corresponding relation between the panel base and the decorative frame in the state shown in FIG. 25.

On the other hand, if the decorative frame 170 is turned through 90°, for example, in the counterclockwise direction with respect to the panel base 130 from the state shown in FIG. 20 to establish a state shown in FIG. 25, as can be seen from the corresponding relation between the side 136*c* and the side 171*a* as shown in FIG. 26, the protrusion 331 and the engagement member 333 of the second engagement means 330 correspond to each other, but the engagement member 313 of the first engagement means 310 has no engagement mate. Also, for the third engagement means 350, the first engagement claw 353 corresponds to the first engagement hole 355, but the second engagement hole has no engagement mate.

Figure 27:
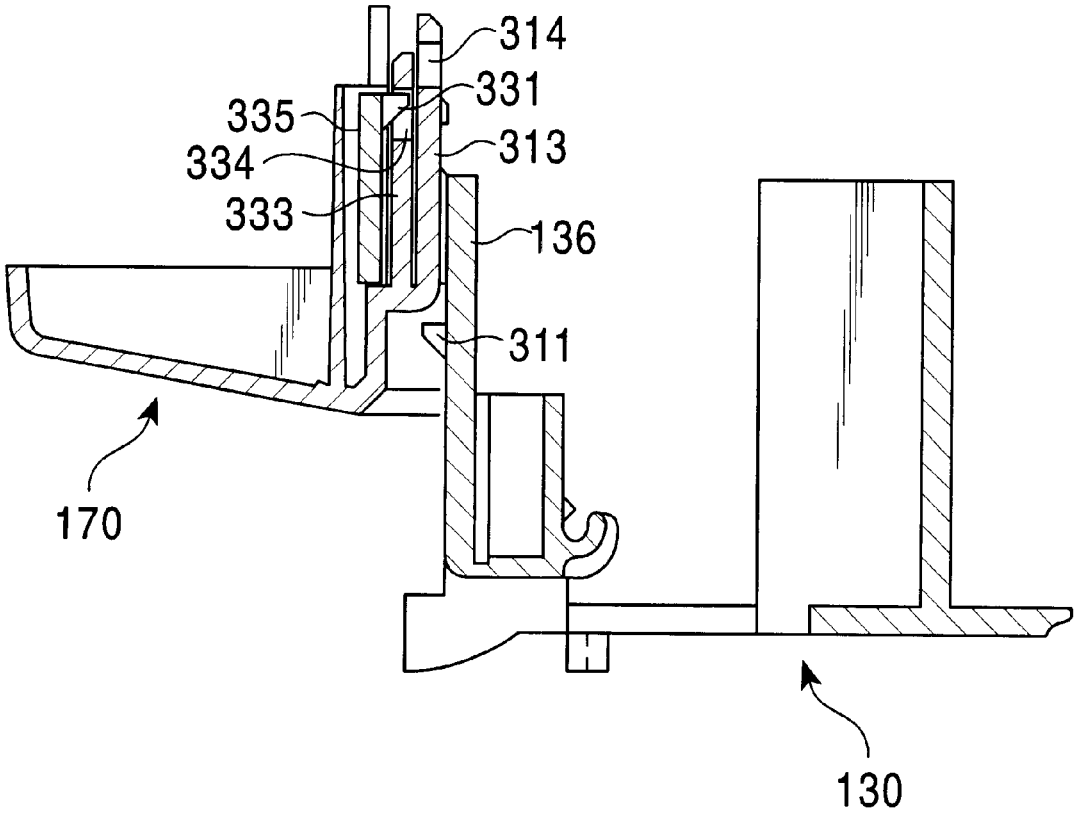
FIG. 27 is a sectional view showing an engagement state of the second engagement means.
Figure 28:
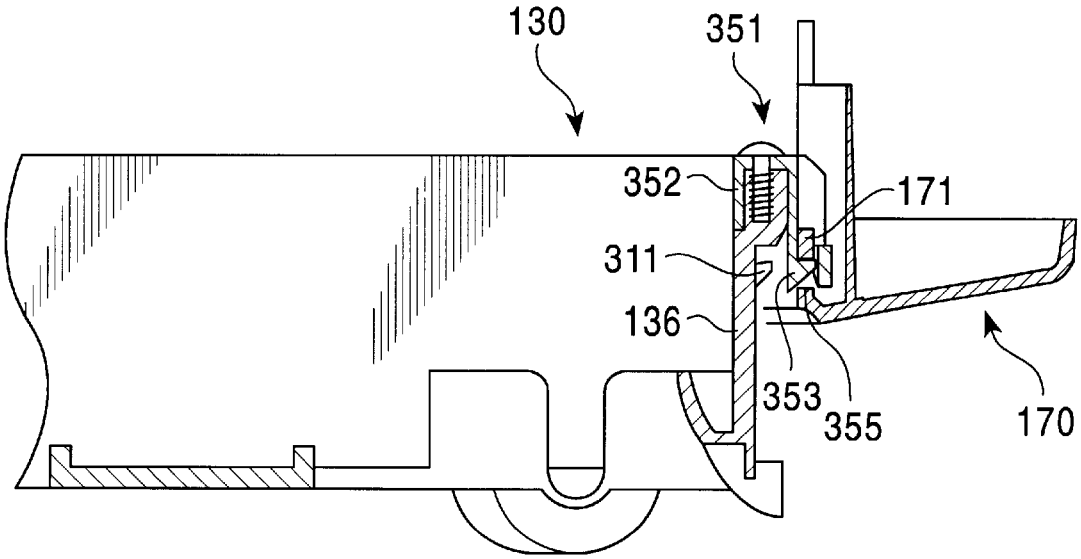
FIG. 28 is a sectional view showing an engagement state of the third engagement means at the time when the second engagement means is engaged.

Therefore, if the decorative frame 170 is pushed up in this state, as shown in a sectional view of FIG. 27, the protrusion 331 of the second engagement means 330 is engaged with the engagement member 333, and also as shown in a sectional view of FIG. 28, the first engagement claw of 353 the third engagement means 350 is fitted into the first engagement hole 355, by which the decorative frame 170 is set at the position B in FIG. 2.

In the above-described embodiments, the opening of the panel base 130 is covered by one suction grille 150, and the suction grille 150 is also used as a front panel. However, in case of ceiling recessed type, the suction grille 150 is considerably large, so that not only it is difficult to mold the suction grille 150, but also a warp or deflection is prone to occur.

Figure 29:
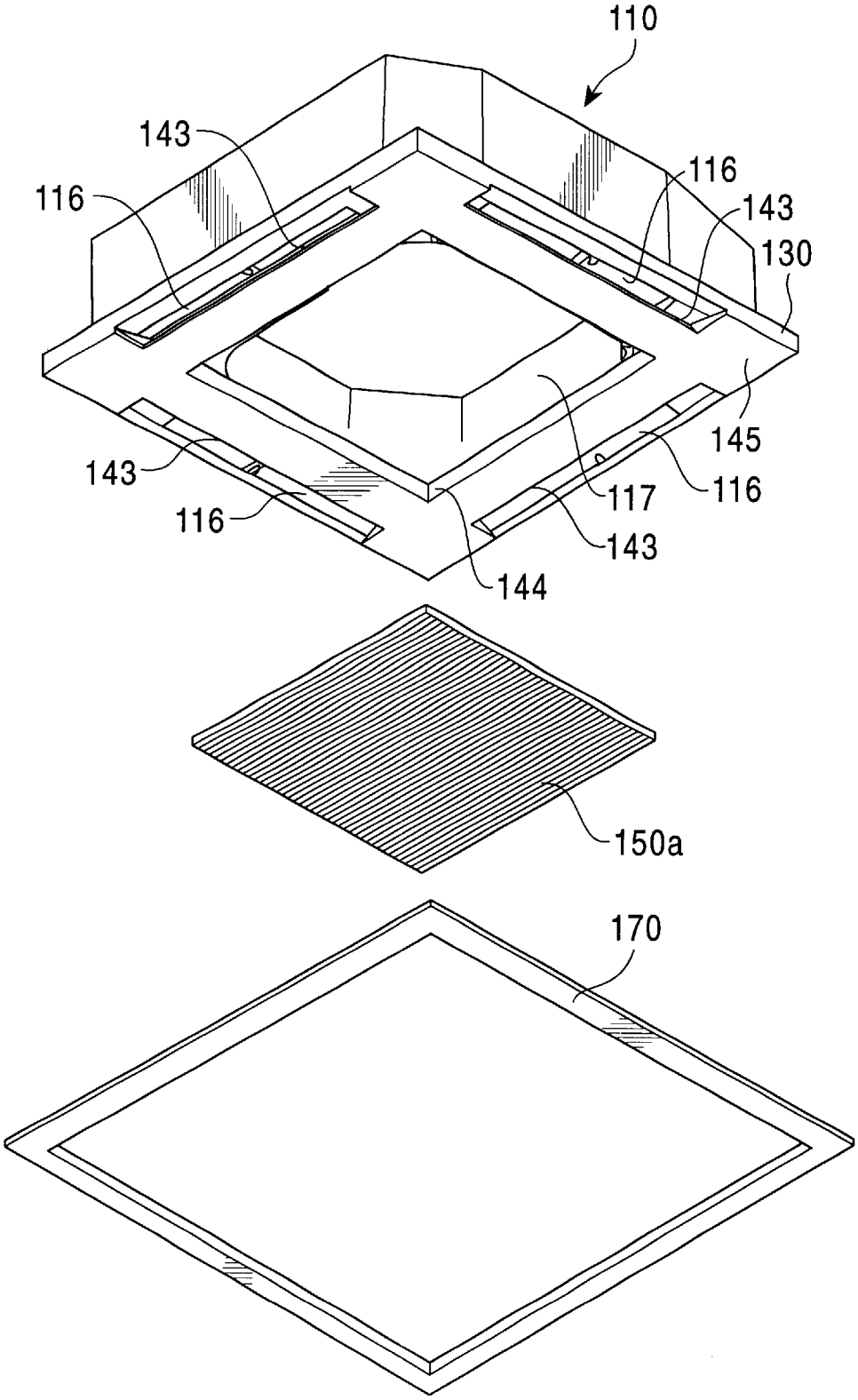
FIG. 29 is an exploded perspective view of a modification of the present invention that is common to the above embodiments.
Figure 30:
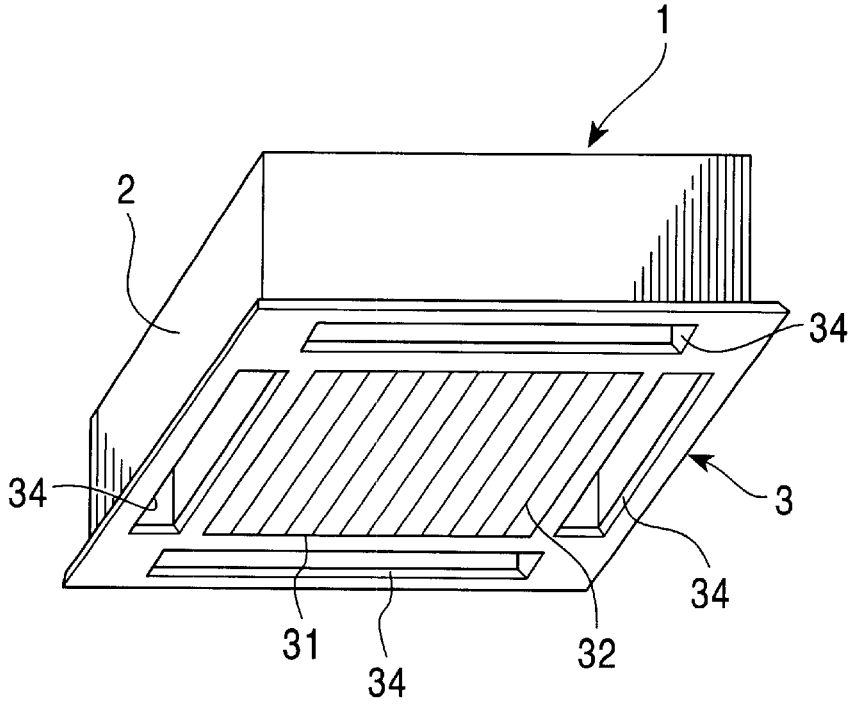
FIG. 30 PRIOR ART
FIG. 30 is a perspective view showing an appearance of a conventional ceiling recessed type air conditioner.
Figure 31:
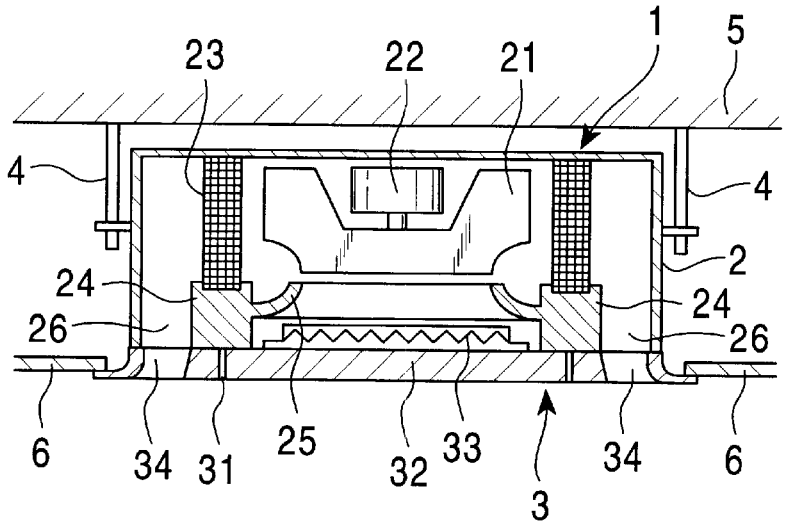
FIG. 31 PRIOR ART
FIG. 31 is a schematic sectional view of the conventional air conditioner installed in the ceiling.

To solve this problem, in a modification of the present invention, as shown in FIG. 29, a front panel 145 is formed integrally with the panel base 130. The front panel 145 has first openings 143 corresponding to the air ports 116 of the case body 110 and a second opening 144 corresponding to the suction port of the bell mouth 117.

Thus, by molding the front panel 145 integrally with the panel base 130 using a mold resin, a base panel with high rigidity, which is also used as a front panel, can be obtained. In this case, a suction grille 150a has a size corresponding to the second opening 144, and is molded separately from the front panel. Even if the panel base 130 is modified in this manner, there is no trouble in setting the decorative frame 170 at different height positions.

Although the embodiments of the present invention have been described in detail, the present invention is not limited to these embodiments. All modifications that could easily be made within a scope which does not depart from the teachings of the present invention is embraced by the present invention.

What is claimed is:

1. An air conditioner comprising:

a case body which comprises a rectangular parallelpiped box having an open lower face on a room side and supported by hanging bolts in a ceiling so that a height thereof is adjustable, said box having a bell mouth and air ports; and a panel base which is formed into a square frame shape and is attached to a lower face side of said case body, said panel base having a side wall, a centrifugal fan, a motor for driving said centrifugal fan, and a heat exchanger disposed around said centrifugal fan, which are all disposed inside the case body, said bell mouth forming a suction port for said centrifugal fan and said air ports allowing air heat-exchanged by said heat exchanger to flow therethrough, air deflectors disposed corresponding to said air ports and a suction grille communicating with the suction port of said bell mouth, which are provided at the panel base, a decorative frame selectively installed at different height positions on the side wall of said panel base, and installation position changing means for selectively installing the decorative frame at the different height positions on the side wall, said installation position changing means including hooks provided on two opposing sides of the decorative frame, shallow first grooves formed on the two opposing sides of the panel base to be able to engage the hooks, and deep second grooves formed on the other two opposing sides of the panel base to be able to engage the hooks, said decorative frame being held at the different height positions by engaging the hooks with one of the first and second grooves.

2. The air conditioner according to claim 1, wherein said hook is formed into an inverse U shape engaging with said one of the grooves from an upside.

3. The air conditioner according to claim 1, wherein ribs, which come into contact with both sides of said hook to restrain a transverse movement of said hook, are provided under said first groove or said second groove.

4. The air conditioner according to claim 3, wherein said rib has an inclined face whose height increases gradually toward a lower side.

5. An air conditioner comprising:

a case body which comprises a rectangular parallelpiped box having an open lower face on a room side and supported by hanging bolts in a ceiling so that a height thereof is adjustable, said box having a bell mouth and air ports; and a panel base which is formed into a square frame shape and is attached to a lower face side of said case body, said panel base having a side wall and corner cut portions at each corner thereof, a centrifugal fan, a motor for driving said centrifugal fan, and a heat exchanger disposed around said centrifugal fan, which are all disposed inside the case body, said bell mouth forming a suction port for said centrifugal fan and said air ports allowing air heat-exchanged by said heat exchanger to flow therethrough, air deflectors disposed corresponding to said air ports and a suction grille communicating with the suction port of said bell mouth, which are provided at the panel base, a decorative frame selectively installed at different height positions on the side wall of said panel base, and installation position changing means for selectively installing the decorative frame at the different height positions on the side wall and having corner members fixed to the corner cut portions for compensating shapes of the corner cut portions, said decorative frame being held on the panel base through the corner members to adjust a height thereof.

6. The air conditioner according to claim 5, wherein the different height positions of said decorative frames are a lower position substantially located on an extension of a surface of said suction grille and an upper position set above said lower position as viewed from a room side.

7. The air conditioner according to claim 5, wherein said panel base is provided with a driving portion for driving said air deflectors, and said driving portion is covered by a protective cover.

8. The air conditioner according to claim 5, wherein said panel base is provided with bearings for rotatably supporting central portions on back surface sides of said air deflectors.

9. The air conditioner according to claim 5, wherein said air port is formed of a heat insulating material, said panel base is provided with an air blow opening communicating with said air port, and the lower end of the heat insulating material forming said air port is tightly inserted between the side wall of said panel base and a side wall of said air blow opening opposing thereto.

10. The air conditioner according to claim 6, wherein the side wall of said air blow opening is formed into a curved shape so as to be curved toward a side wall lower end side of said panel base.

11. The air conditioner according to claim 5, wherein said panel base is made of a synthetic resin and is molded integrally with a front panel having first openings corresponding to said air ports and a second opening corresponding to the suction port of said bell mouth, and each air deflector is disposed in said first opening and said suction grille is detachably mounted in said second opening.

12. An air conditioner comprising:

a case body which comprises a rectangular parallelpiped box having an open lower face on a room side and supported by hanging bolts in a ceiling so that a height thereof is adjustable, said box having a bell mouth and air ports; and a panel base which is formed into a square frame shape and is attached to a lower face side of said case body, said panel base having a side wall, a centrifugal fan, a motor for driving said centrifugal fan, and a heat exchanger disposed around said centrifugal fan, which are all disposed inside the case body, said bell mouth forming a suction port for said centrifugal fan and said air ports allowing air heat-exchanged by said heat exchanger to flow therethrough, air deflectors disposed corresponding to said air ports and a suction grille communicating with the suction port of said bell mouth, which are provided at the panel base, a decorative frame selectively installed at different height positions on the side wall of said panel base, and installation position changing means for selectively installing the decorative frame at the different height positions on the side wall and including first and second engaging means engaging the panel base, said first engaging means engaging the panel base at a position lower than that by the second engaging means when the decorative frame is fitted onto the panel base from a downside to an upside on a room side.

13. The air conditioner according to claim 9, wherein the different height positions of said decorative frames are a lower position substantially located on an extension of a surface of said suction grille and an upper position set above said lower position as viewed from a room side.

14. The air conditioner according to claim 9, wherein said panel base is provided with a driving portion for driving said air deflectors, and said driving portion is covered by a protective cover.

15. The air conditioner according to claim 9, wherein said panel base is provided with bearings for rotatably supporting central portions on back surface sides of said air deflectors.

16. The air conditioner according to claim 9, wherein said air port is formed of a heat insulating material, said panel base is provided with an air blow opening communicating with said air port, and the lower end of the heat insulating material forming said air port is tightly inserted between the side wall of said panel base and a side wall of said air blow opening opposing thereto.

17. The air conditioner according to claim 13, wherein the side wall of said air blow opening is formed into a curved shape so as to be curved toward a side wall lower end side of said panel base.

18. The air conditioner according to claim 9, wherein said panel base is made of a synthetic resin and is molded integrally with a front panel having first openings corresponding to said air ports and a second opening corresponding to the suction port of said bell mouth, and each air deflector is disposed in said first opening and said suction grille is detachably mounted in said second opening.

19. The air conditioner according to claim 5, wherein said corner member has right and left side plates bent through 90 degrees, an attachment portion which is screwed to the corner of said panel base is provided on an inside of said corner member, and screw insertion holes are formed at different height positions in at least one of said side plates, so that said decorative frame is fixed to one screw insertion hole.

20. The air conditioner according to claim 5, wherein an L-shaped step portion for engaging with an inside face of said corner cut portion is formed at an end of each side plate of said corner member to make the side face of said corner member and the side face of said panel base flush with each other.

21. The air conditioner according to claim 9, wherein when said decorative frame is fitted onto said panel base, by turning said decorative frame through 90 degrees in a horizontal plane, either one of said engagement means is selected.

22. The air conditioner according to claim 9, wherein said engagement means comprises a combination of a protrusion provided on the side wall of said panel base and an elastically deformable engagement member which has a fit hole fitting onto said protrusion, and is formed on an inside wall of said decorative frame.

23. The air conditioner according to claim 9, wherein between said panel base and said decorative frame, said first engagement means and said second engagement means are provided adjacently at two places at right and left ends of each side so as to be asymmetrical with respect to a centerline of said side, and positions of said first engagement means and said second engagement means are changed on the two opposing sides and on other two opposing sides.

24. The air conditioner according to claim 12, wherein a protrusion of said first engagement means is provided directly on the side wall of said base panel, while a protrusion of said second engagement means is provided on an inside face of a portal frame formed on the side wall of said panel base, and an engagement member of said first engagement means is provided so as to come into contact with the side wall of said panel base, while an engagement member of said second engagement means is provided so as to come into contact with the inside face of said portal frame.

25. The air conditioner according to claim 9, wherein said installation position changing means is further provided, in addition to said first and second engagement means, with third engagement means for holding a central portion of said decorative frame, and said third engagement means has two engagement claws provided in parallel at the same height position at a central portion of each wall of said decorative frame and two engagement holes formed in parallel at different height positions at the central portion of each inside wall of said decorative frame so that one engagement claw is fitted into one engagement hole at the higher position when said first engagement means is selected and the other engagement claw is fitted into the other engagement hole at the lower position when said second engagement means is selected.

26. The air conditioner according to claim 1, wherein the different height positions of said decorative frame are a lower position substantially located on an extension of a surface of said suction grille and an upper position set above the said lower position as viewed from the room side.

27. The air conditioner according to claim 1, wherein said panel base is provided with a driving portion for driving said air deflectors, and said driving portion is covered by a protective cover.

28. The air conditioner according to claim 1, wherein said panel base is provided with bearings for rotatably supporting central portions on back face sides of said air deflectors.

29. The air conditioner according to claim 1, wherein said air port is formed of a heat insulating material, said panel base is provided with an air blow opening communicating with said air port, and the lower end of the heat insulating material forming said air port is tightly inserted between the side wall of said panel base and a side wall of said air blow opening opposing thereto.

30. The air conditioner according to claim 29, wherein the side wall of said air blow opening is formed into a curved shape so as to be curved toward a side wall lower end side of said panel base.

31. The air conditioner according to claim 1, wherein said panel base is made of a synthetic resin and is molded integrally with a front panel having first openings corresponding to said air ports and a second opening corresponding to the suction port of said bell mouth, and each air deflector is disposed in said first opening and said suction grille is detachably mounted in said second opening.

* * * * *

UNITED STATES PATENT AND TRADEMARK OFFICE

CERTIFICATE OF CORRECTION

PATENT NO. : 6,393,856 B1
DATED : May 28, 2002
INVENTOR(S) : Yoshihiro Gunji et al.

It is certified that error appears in the above-identified patent and that said Letters Patent is hereby corrected as shown below:

Column 14,
Line 30, "delete "said"; and
Line 31, change "the" to -- said --

Column 15,
Line 18, change "claim 6" to -- claim 9 --;
Line 56, change "claim 9" to -- claim 12 --;
Line 61, change "claim 9" to -- claim 12 --; and
Line 65, change "claim 9" to -- claim 12 --.

Column 16,
Lines 1 and 12, change "claim 9" to -- claim 12 --;
Line 8, change "claim 13" to -- claim 16 --;
Lines 33, 38 and 44, "claim 9" to -- claim 12 --;
Line 51, delete "the"; and
Line 62, change "claim 9" to -- claim 12 --.

Column 17,
Line 14, change second "the" to -- a --.

Signed and Sealed this

Fifth Day of August, 2003

JAMES E. ROGAN
*Director of the United States Patent and Trademark Office*